US005702297A

United States Patent [19]

Anderson et al.

[11] Patent Number: 5,702,297

[45] Date of Patent: Dec. 30, 1997

[54] SLOT VENTILATOR

[75] Inventors: John Neil Anderson, Suffolk; Arthur Stoney, Essex, both of England

[73] Assignee: Titon Hardware Limited, Essex, England

[21] Appl. No.: 619,482

[22] PCT Filed: Sep. 30, 1994

[86] PCT No.: PCT/GB94/02130

§ 371 Date: Jun. 24, 1996

§ 102(e) Date: Jun. 24, 1996

[87] PCT Pub. No.: WO95/09333

PCT Pub. Date: Apr. 6, 1995

[30] Foreign Application Priority Data

Sep. 30, 1993 [GB] United Kingdom ..... 9320194

[51] Int. Cl.[6] ..... F24F 13/18

[52] U.S. Cl. ..... 454/213; 454/273

[58] Field of Search ..... 454/211, 213, 454/215, 217, 219, 222, 273, 274, 333, 334

[56] References Cited

U.S. PATENT DOCUMENTS

| | | | |
|---|---|---|---|
| 1,136,541 | 4/1915 | Leary | 454/217 |
| 1,204,158 | 11/1916 | Ingle | 454/211 |
| 2,491,863 | 12/1949 | Koch | 454/217 |
| 3,194,145 | 7/1965 | Robertson, Jr. . | |
| 4,702,157 | 10/1987 | Comparon | 454/211 |

FOREIGN PATENT DOCUMENTS

| | | | |
|---|---|---|---|
| 584408 | 1/1947 | United Kingdom . | |
| 635003 | 3/1950 | United Kingdom . | |
| 1417751 | 12/1975 | United Kingdom . | |
| 2 063 460 | 6/1981 | United Kingdom | 454/211 |
| 2 127 144 | 4/1984 | United Kingdom | 454/213 |

*Primary Examiner*—Harold Joyce

*Attorney, Agent, or Firm*—Price, Heneveld, Cooper, Dewitt & Litton

[57] ABSTRACT

A slot ventilator (100, 500) comprises a slotted backing member (24, 124, 424, 524), an elongate facing strip (26, 126, 426, 526, 626), and a linkage mechanism connecting the backing member and facing strip with one another, the linkage mechanism being arrange to permit generally translational forward and backward movement of the facing strip between a closed position in which the slot is closed and an open position in which the facing strip is spaced in front of the backing member. The linkage mechanism includes a hinge (58, 158, 300) allowing the facing strip to rotate about a longitudinal axis to vary the angular orientation thereof. When installed horizontally in a window frame (14, 588, 588') the facing strip may be moved forwards and backwards to increase and decrease ventilation, and may be rotated about the hinge to divide incoming ventilation favourably between downward and upward directions.

20 Claims, 20 Drawing Sheets

FIG. 4A
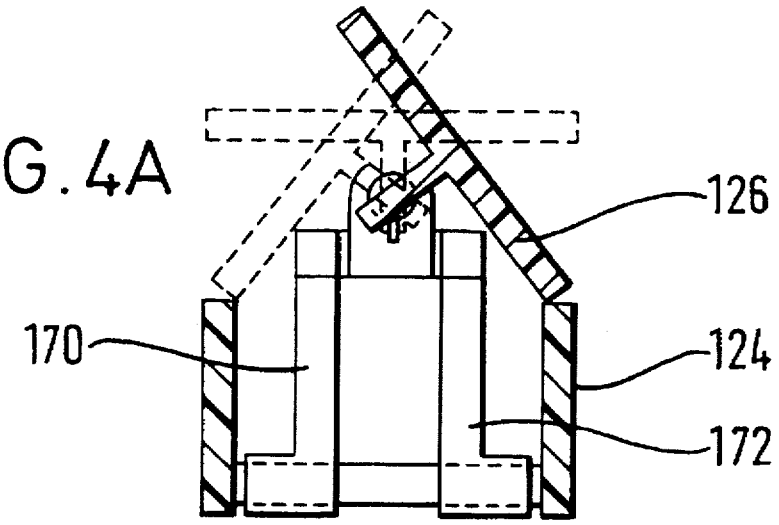
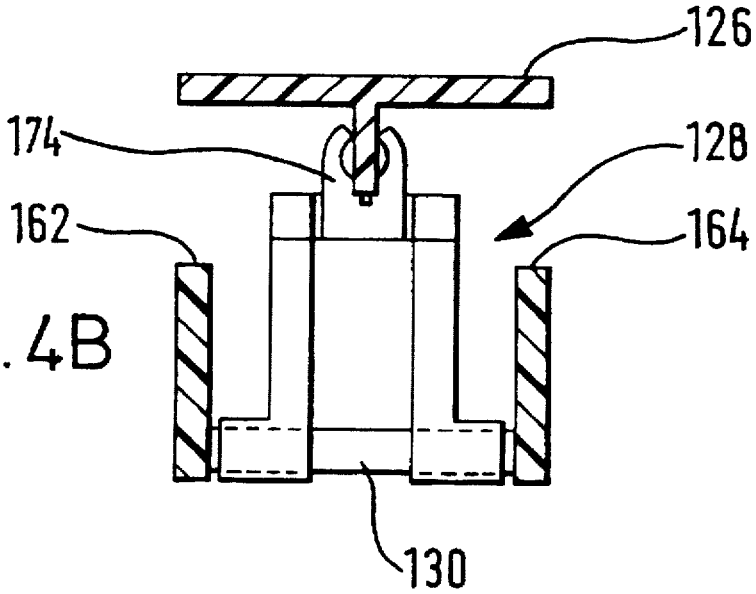
FIG. 4B
FIG. 4C
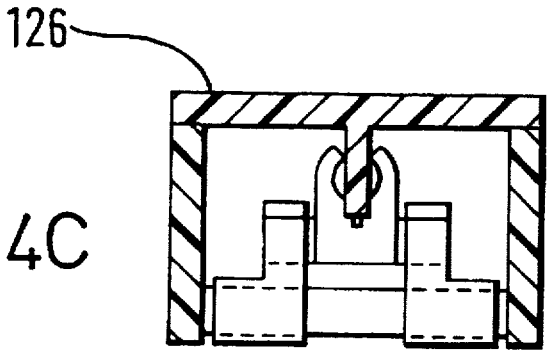
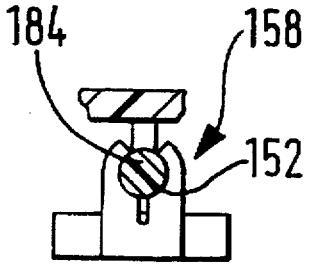
FIG. 4D

FIG. 6A
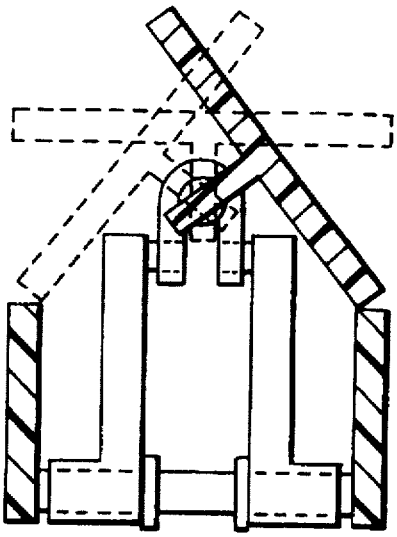
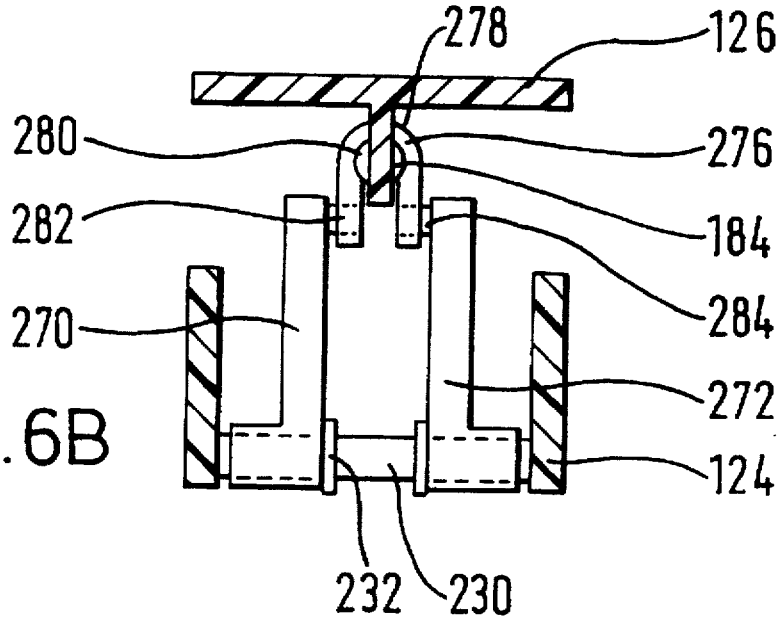
FIG. 6B
FIG. 6C
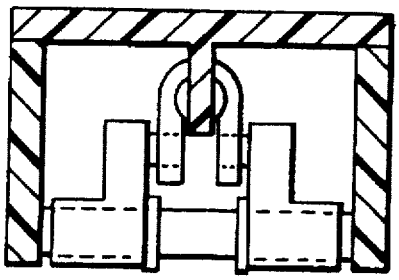

FIG. 8A
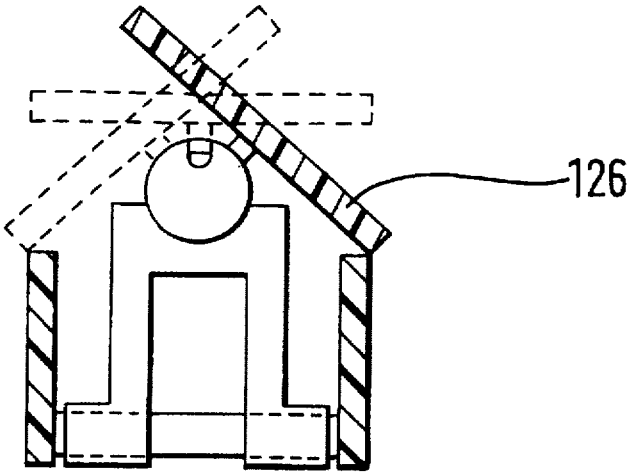
FIG. 8B
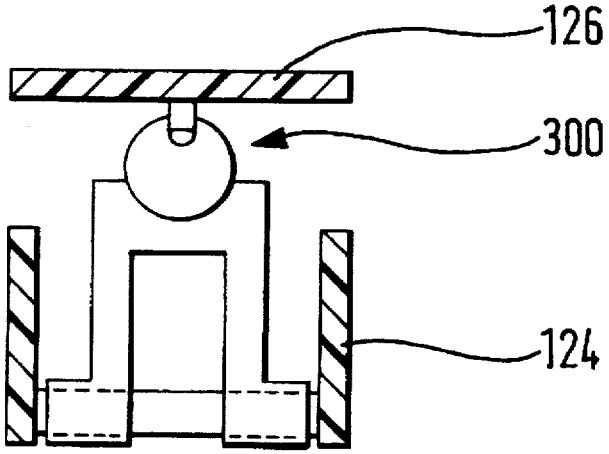
FIG. 8C
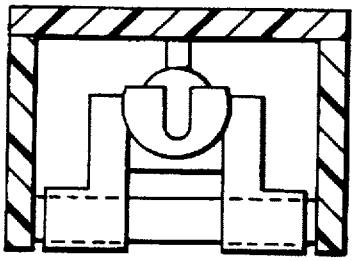
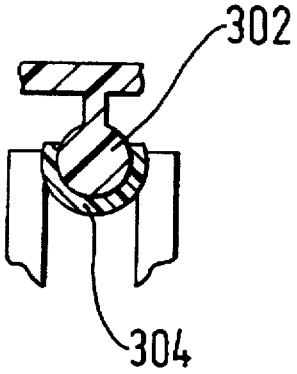
FIG. 8D

FIG. 24
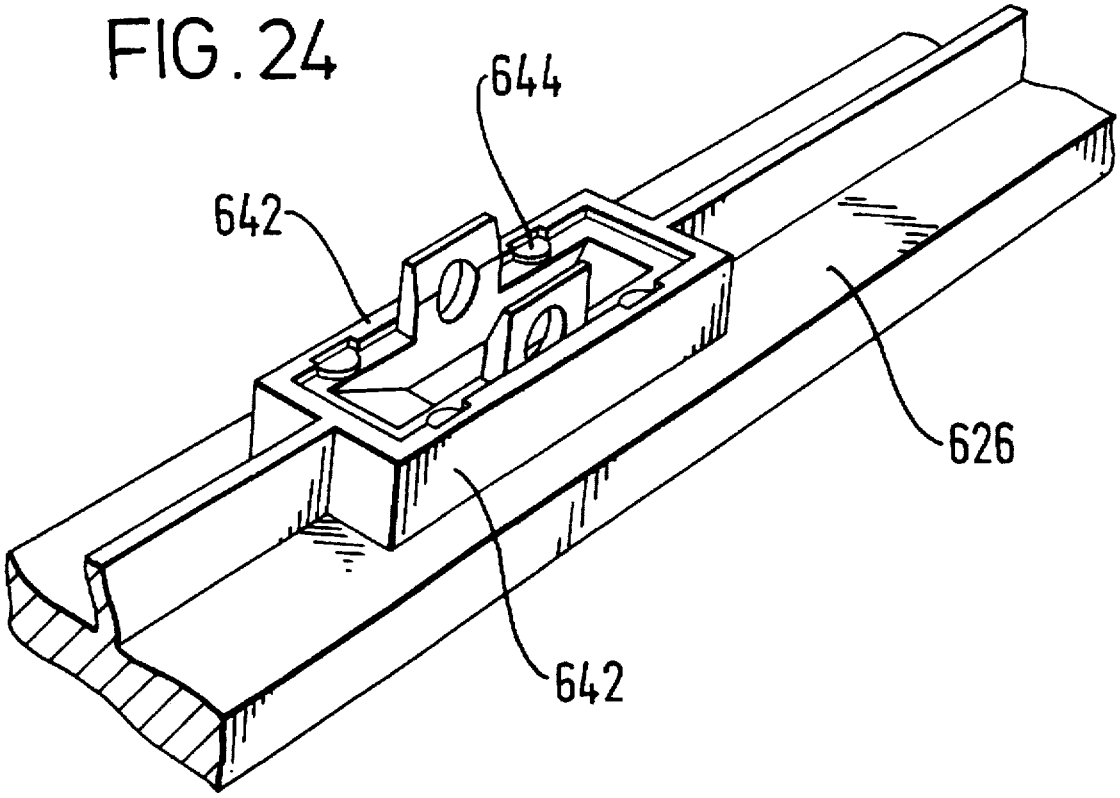
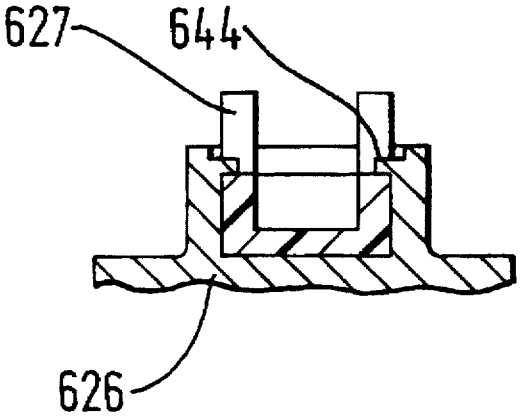
FIG. 25

SLOT VENTILATOR

The present invention relates to a slot ventilator, for example for use in a room with a sealed window or a window with double or single glazing or a door wherein it is desirable to provide ventilation without having to open the window.

GB1417751 discloses a slot ventilator comprising a slotted backing member, an elongate facing strip, and a linkage mechanism connecting the backing member and facing strip with one another, the linkage mechanism being arranged to permit generally translational forward and backward movement of the facing strip between a closed position in which the slot is closed and an open position in which the facing strip is spaced in front of the backing member.

Although this prior art arrangement performs well in most circumstances, there are applications in which increased control of ventilation would be desired.

The present invention aims at least to alleviate this problem.

According to the present invention there is provided a slot ventilator comprising a slotted backing member, an elongate facing strip and a linkage mechanism connecting the backing member and facing strip with one another, the linkage mechanism being arranged to permit generally translational forward and backward movement of the facing strip between a closed position in which the slot is closed and an open position in which the facing strip is spaced in front of the backing member, the linkage mechanism including a hinge allowing the facing strip to rotate about a longitudinal axis to vary the angular orientation thereof.

This arrangement has the advantage that the angular orientation of the facing strip may be varied to alter the direction of ventilation passing through the ventilator. When the ventilator is installed in a horizontal position, for example, in one embodiment the angular orientation of the facing strip may be varied to increase the amount of incoming ventilation directed downwards by the facing strip whilst decreasing the amount directed upward, and vice versa. Control of ventilation is therefore significantly improved.

Preferably, the facing strip is movable to the closed position from the open position by a generally translational backward movement, irrespective of the angular orientation thereof. This has the advantage that the ventilator is easy to operate. In preferred embodiments, the ventilator may therefore be closed simply with a rearward pushing force applied by the user thereof.

Preferably, the facing strip, in an angular configuration thereof, engages the front of a wall defining the slot. In an embodiment where the ventilator is installed horizontally, it may therefore be possible selectively to prevent incoming ventilation from being directed either upward or downward, since the engagement may at least to some extent seal the facing strip and the front of the wall, preventing ventilation from passing there-between. The facing strip may be slidable over the front of the wall defining the slot during closing movement of the facing strip. Such a sliding movement provides a convenient way automatically to reset the angular orientation of the facing strip to that of the closed position as the facing strip is closed.

Preferably, the facing strip is selectable to an intermediate angular orientation intermediate that of the closed position and that of a fully deflected angular orientation. The facing strip may be rotationally selectable between an infinite number of said intermediate orientations. This gives a high degree of control for ventilation.

The linkage mechanism may include a friction lock for locking the facing strip by friction in a said intermediate orientation.

Preferably, the linkage mechanism includes at least two said links which may be substantially identical with one another, the links being spaced from one another along the length of the slot.

In one embodiment, the linkage mechanism includes a link which is pivotally connected to the backing member. The link may comprise one or a pair of linkage arms, the or each linkage arm being pivotally connected at a first end thereof to the backing member. The link preferably includes at a second end or ends of the or each linkage arm a first hinging component, the first hinging component being coupled to a second hinging component which is mounted to the facing strip.

The first and second hinging components are preferably separate components, but it is also envisaged that they could be formed integrally, being joined together by a web of material forming an integral hinge therebetween.

The second hinging component may be formed separately from or formed integrally with the facing strip of the ventilator. When they are formed separately, one of the facing strip and second hinging component may include a recess and the other a formation adapted for location in the recess. Preferably, one of the formation and recess is deformable for locking the formation and recess together. In a preferred embodiment, the second hinging component includes a base portion which is locatable in a recess of the facing strip, the recess including wall portions which, after insertion of the base portion, are deformable over the base portion to hold the base portion captive in the recess.

In a most preferred embodiment, the linkage arm and first hinging component are of plastics material and the second hinging component is formed integrally with the facing strip, also of plastics material. However, a metal facing strip is preferred for some applications and, when a metal facing strip is employed, it is preferred for the second hinging component to be formed separately therefrom from plastics material, the first hinging component also being plastics. In most embodiments, there will be sliding movement between the first and second hinging components as the facing strip is rotated to different angular orientations; the use of plastics for both of the first and second hinging components ensures that these components do not wear unduly as a result of sliding movement between them.

When a pivotal link is employed, the link is preferably provided with a stop portion (e.g. on a linkage arm thereof), which may be in the form of a protruding abutment, which is adapted, on movement of the facing strip to the open position, to engage a stop portion of the facing strip or, more preferably, the backing member, engagement of the respective stop portions preventing movement of the facing strip past, and thus defining, the open position. In a most preferred embodiment, the link stop portion is adapted to engage a stop portion of the backing member, the backing member stop portion comprising a bridge element which extends between two side walls of the backing member.

The slotting backing member (and/or the facing strip) preferably includes a selection of linkage mechanism mounting formations. When the linkage mechanism includes one or more pivotal links, the maximum extent of forward movement of the facing strip from the closed position to the open position may be predetermined by selection of a pivotal link of appropriate length; an application where the backing member is recessed into a structural element to which it is mounted might require further relative forward movement of the facing strip than an application in which the backing member is mounted on the surface of the structural element to achieve the same level of ventilation.

It may be desirable for the facing strip and backing member to take up the same relative position in the closed position, irrespective of the length of selected pivotal link. Since, in most embodiments, the relative position taken up by the facing strip and backing member in the closed position will be at least partially determined by the length of the selected pivotal link, providing the backing member or facing strip with a selection of linkage mechanism mounting formations permits an appropriate mounting formation to be selected dependent upon the length of the pivotal link.

In a preferred embodiment, when the linkage mechanism includes a series of two or more links which are substantially spaced from one another along the length of a slot, the backing member preferably includes a selection of two or more corresponding series of mounting formations spaced from one another along the length of the slot. In a most preferred embodiment, the mounting formations comprise two or more series of pivot bars which extend across the slot formed by the backing member around which linkage arms of the linkage mechanism are adapted to pivot.

Preferably, the linkage mechanism is adapted to restrain the motion of each end of the facing strip, during forward movement of the facing strip, to motion along a predetermined course, the position of each end during such motion being dependent upon the position of the other end. Thus, if one end of the flap is moved forward to the open position, the other end also moves, automatically, to the open position. More preferably, the linkage mechanism is adapted to restrain the two ends of the flap to movement, in unison, with a longitudinal axis of the facing strip being maintained substantially parallel to a longitudinal axis of the backing member.

Preferably, the linkage mechanism links a rearwardly facing surface of the facing strip with the opposing side faces of walls defining the slot of the backing member. In the closed position, the entire linkage mechanism preferably lies to the rear of the facing strip, between (preferably entirely between) the opposing faces of walls defining the slot of the backing member. Thus the ventilator can be made extremely compact.

The or each linkage arm may be of resilient material such that the link is a snap-fit, during assembly, to the backing member. The or each linkage arm may include a jaw at the first end thereof, the jaw being arranged to snap-fit on to a pivot bar which extends across the slot formed by the backing member. When only one linkage arm is provided, the linkage arm may terminate at a T-piece, the opposite sides of the T-piece including pegs which are arranged to snap-fit into bores formed in either side of the slot. The first hinging component may be pivotally coupled to the or each linkage arm, by means of a peg (or pegs) on one of the first hinging component and the (or each) linkage arm which projects (or project) into a bore (or bores) in the other. The bores may be longitudinally slotted to provide jaws arranged for snap-fit connection to the pegs during assembly of the ventilator.

The first hinging component may snap-fit, during assembly, to the second hinging component. Preferably, one of the first and second hinging components includes an element with a cylindrical (or part-cylindrical) exterior surface and the other includes a collar which is arranged grippingly to engage the exterior surface of the element. The cylindrical collar preferably includes a longitudinal slot through which the element is insertable with a snap-fit to engage the collar. In one embodiment the collar forms part of the first hinging element and, during assembly, snap-fits onto the second hinging component, the element with the cylindrical surface being mounted to the facing strip with its axis aligned with the longitudinal direction of the facing strip. In this case, the cylindrical element may be mounted at each end thereof to a rib mounted to or formed integrally with the rear of the facing strip.

Instead of employing a collared first hinging component which is arranged to snap-fit on to the cylindrical element, a U-shaped saddle may be employed, the seat of the saddle incorporating a part-cylindrical surface for engagement with the cylindrical element of the second hinging component, the legs of the saddle including bores (or pegs) arranged for pivotal connection to pegs on (or bores in) each of two said linkage arms.

Instead of employing a linkage mechanism with linkage arms pivotally coupled to the backing member, the linkage mechanism could incorporate a camming mechanism, the camming mechanism being arranged to provide the generally translational forward and backward movement of the facing strip. The camming mechanism may incorporate cams arranged to run in cam tracks. Other types of mechanism may be employed to provide the generally forward and backward movement.

Other types of linkage mechanism which would give the facing strip equivalent degrees of freedom of movement are envisaged. For example, instead of the engagement of the cylindrical (or part-cylindrical) surfaces of the element and collar or saddle, each link could incorporate a universal ball and socket joint, with one of the first and second hinging components comprising the ball and the other the socket.

In one preferred embodiment, the first hinging component comprises a ball with two flatted opposing surfaces, the socket comprising a pair of spaced circular bearing surfaces preferably formed by a pair of parallel laterally spaced ribs mounted or integral with the facing strip, the socket including adjacent generally circular cutouts, the spacing between the bearing surfaces preferably being approximately equal to the distance between the opposing flatted surfaces of the ball. This has the advantage of easy assembly, the ball being insertable between the bearing surfaces with its flatted surfaces one adjacent to each bearing surface, the ball then being rotatable 90 degrees to an orientation in which the flatted surfaces are aligned perpendicular to the longitudinal direction of the bearing surfaces, with the spherical surface of the ball engaging each of the circular cutouts, this locking the ball and socket together. When the bearing surfaces are located with a longitudinal direction thereof aligned with that of the slot, the socket may include slotted cutouts extending from the circular cutouts to permit the facing strip to rotate about the hinge (formed by two longitudinally spaced ball and socket joints) with the linkage arm to which the ball is mounted extending into the slotted cutouts during rotation.

As an alternative to or in addition to the slotted cutouts, the socket may be provided with ramped surface portions adjacent or overlapping the slotted cutouts, the ramped surface portions diverging away from one another with increasing distance from the centres of the slotted cutouts.

The slotted cutouts or ramped surface portions prevent jamming of the facing strip as it is rotated between angular orientations thereof and when, ramped surface portions are employed, these permit easier assembly of the ventilator.

When a link of the linkage mechanism incorporates a ball and socket joint, the socket and ball portions of the joint may be adapted resiliently to engage one another so that the facing strip is coupled frictionally to the backing member, preferably to the extent that the facing strip is lockable by friction in a selected angular orientation relative to the backing member. In a most preferred embodiment, the ball portion comprises a split ball, the split ball comprising a plurality (preferably two) of sphere portions which are resiliently coupled together so as to engage the socket portion frictionally with spherical outwardly-facing surfaces of the sphere portions being resiliently biased towards the socket portion.

Preferably, the ventilator includes a snib located on or recessed into the front surface of the facing strip for operating the ventilator. Preferably, the snib is operable backwards and forwards to move the facing strip between the closed and open positions and, preferably, the snib is movable upward and downward to vary the angular orientation of the facing strip.

The present invention may be carried out in various ways. Several embodiments of slot ventilators in accordance with the invention will now be described, by way of example, with reference to the accompanying drawings, in which:

FIGS. 4A, 4B, 4C and 4D are various part-sectional end views of a slot ventilator in accordance with a second embodiment of the present invention;

Figure 5A:
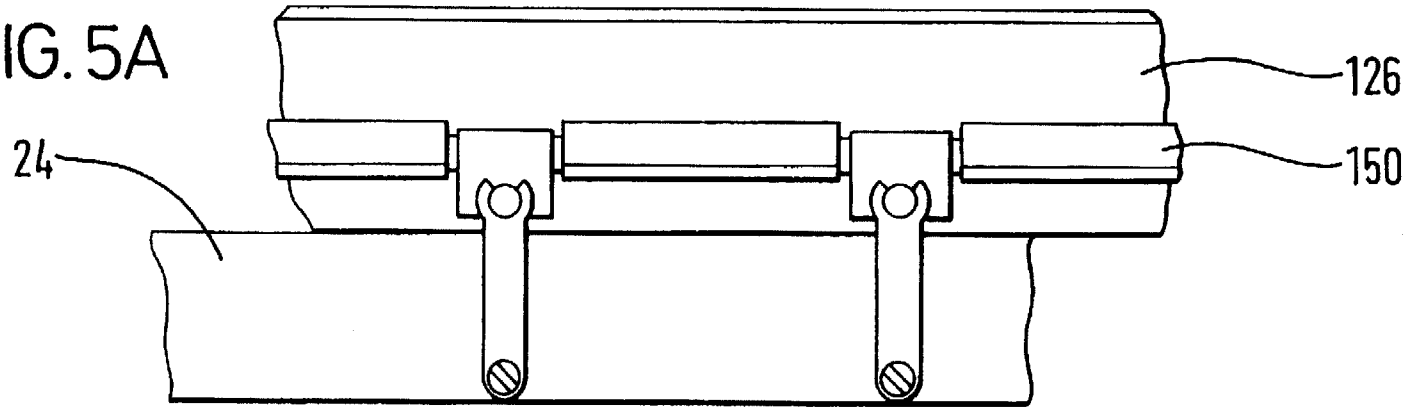
Figure 5B:
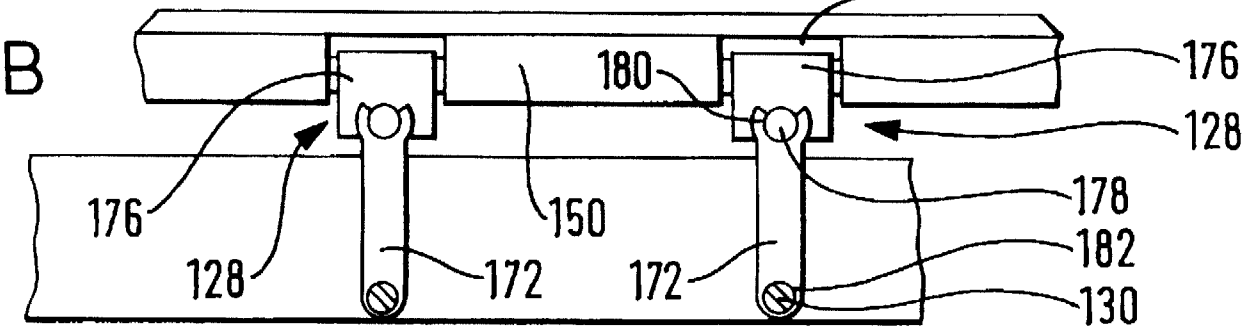
Figure 5C:
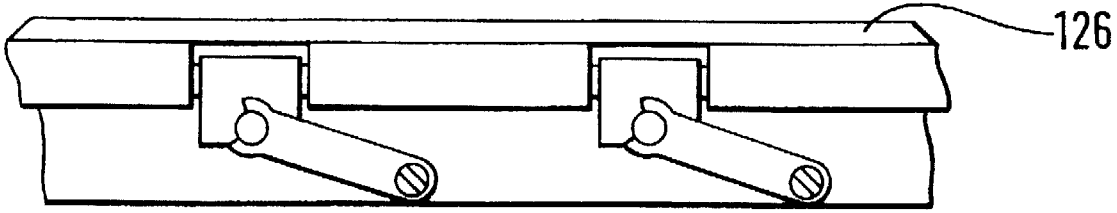
Figure 7A:
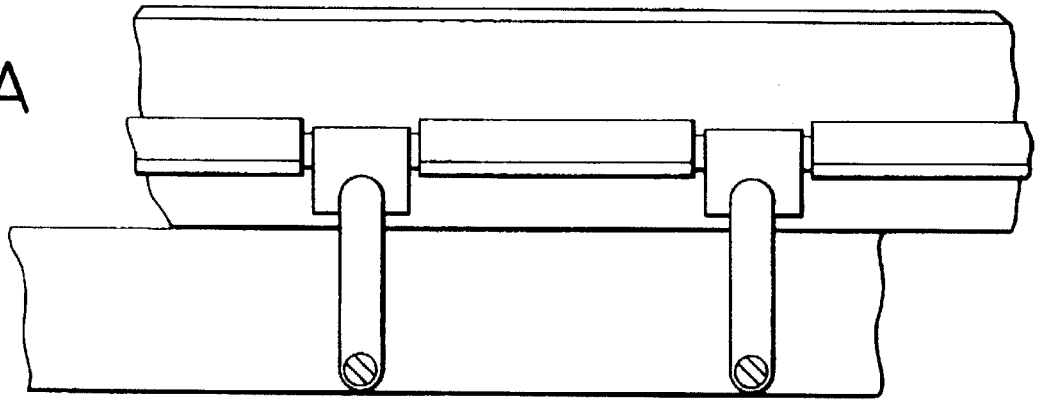
Figure 7B:
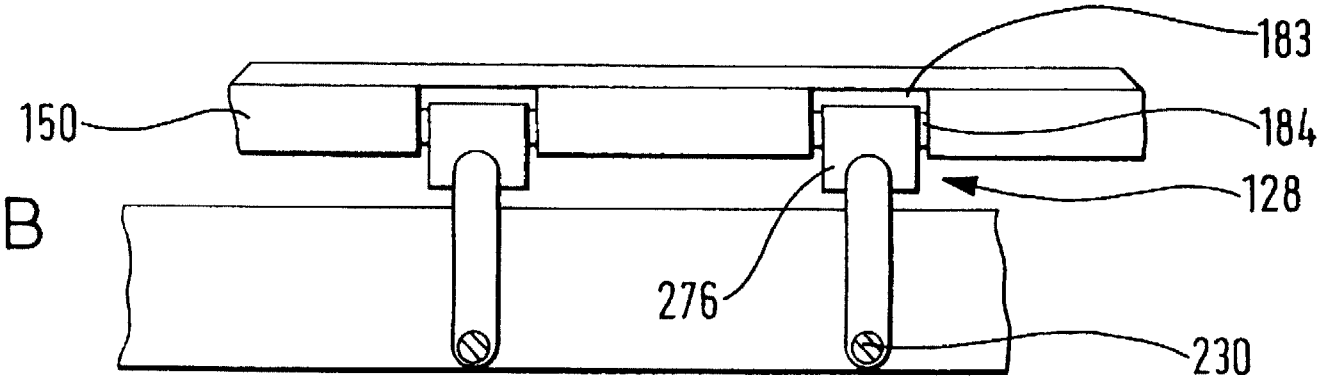
Figure 7C:
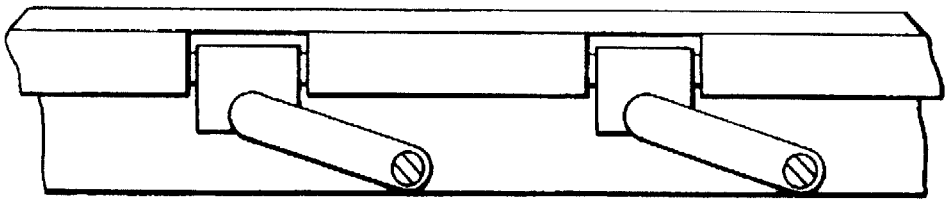
Figure 9A:
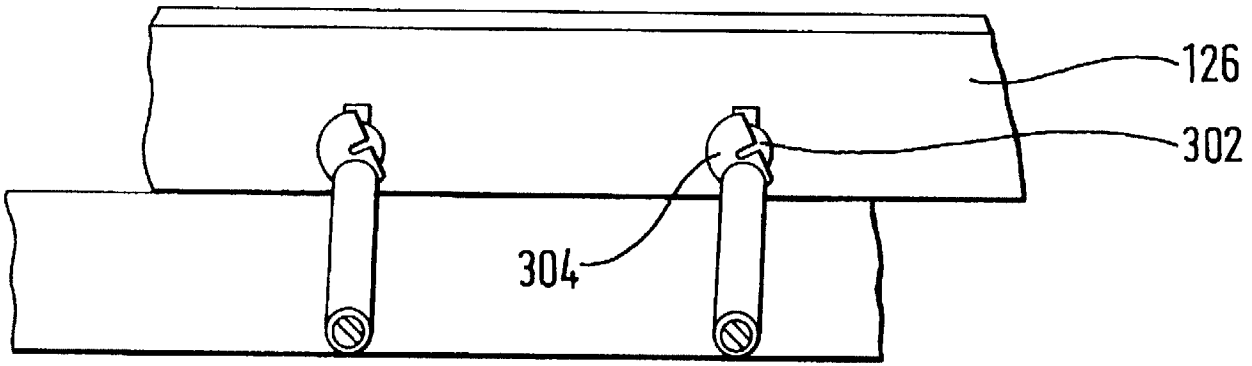
Figure 9B:
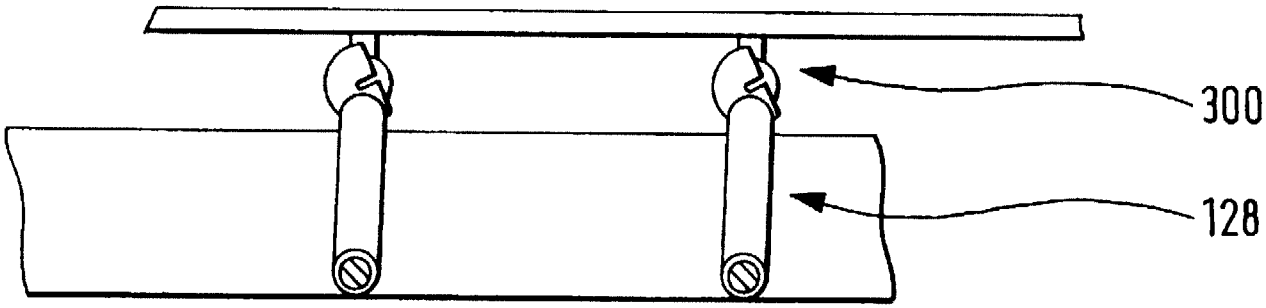
Figure 9C:
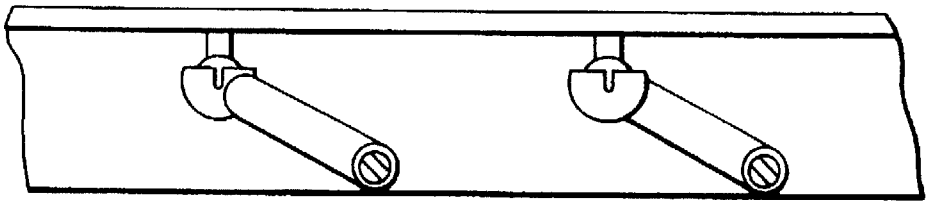
Figure 10A:
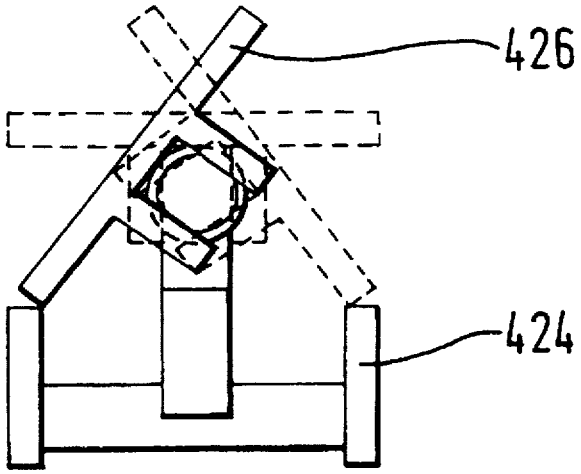
Figure 10B:
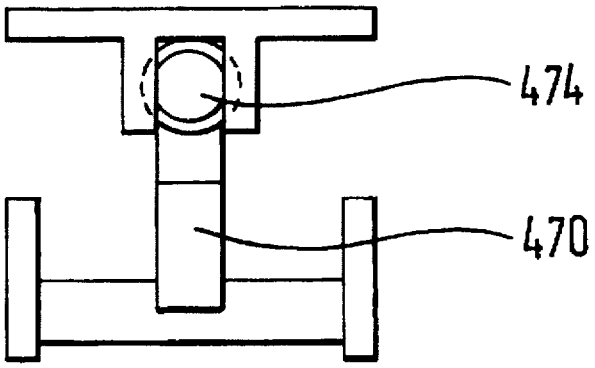
Figure 10C:
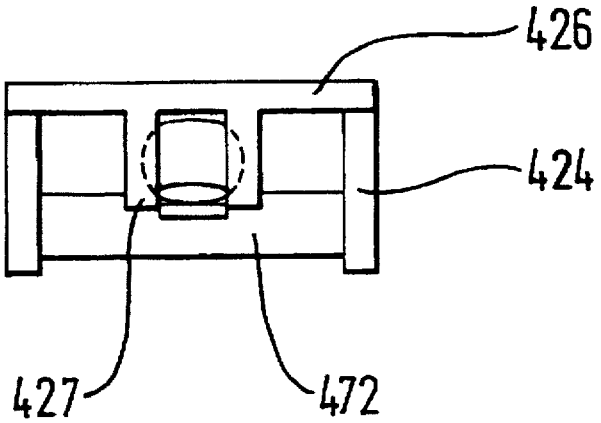
Figure 11A:
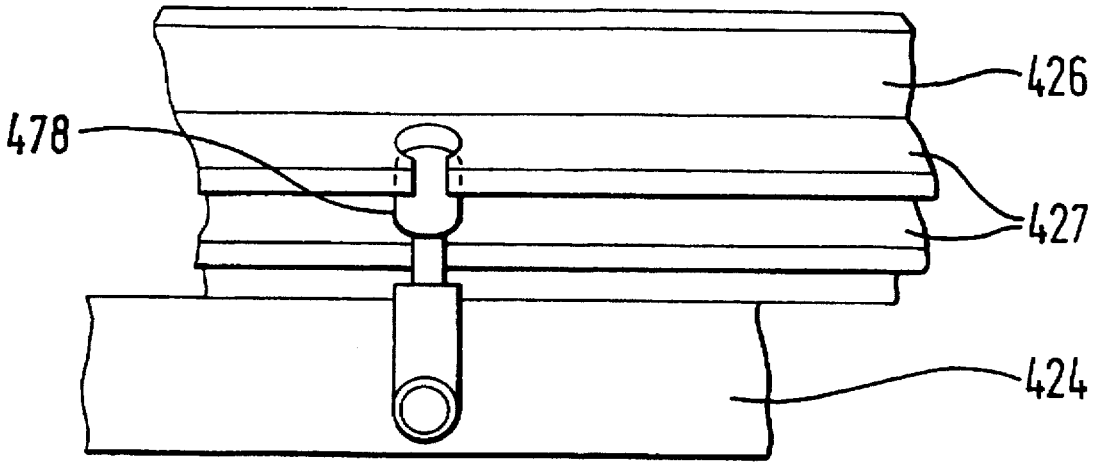
Figure 11B:
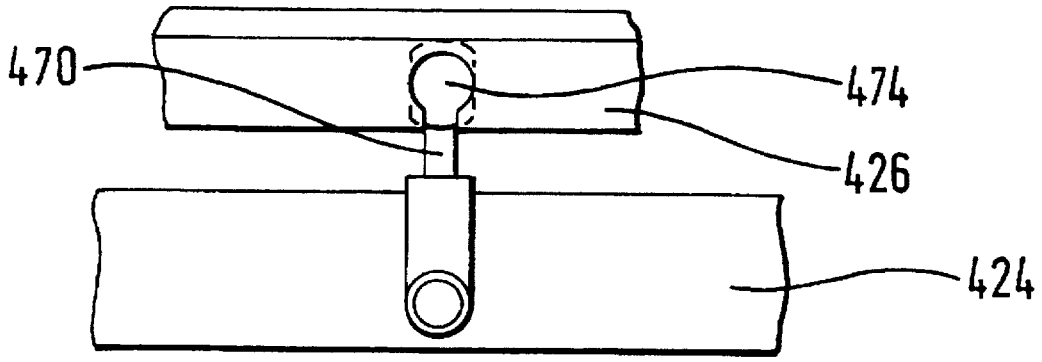
Figure 11C:
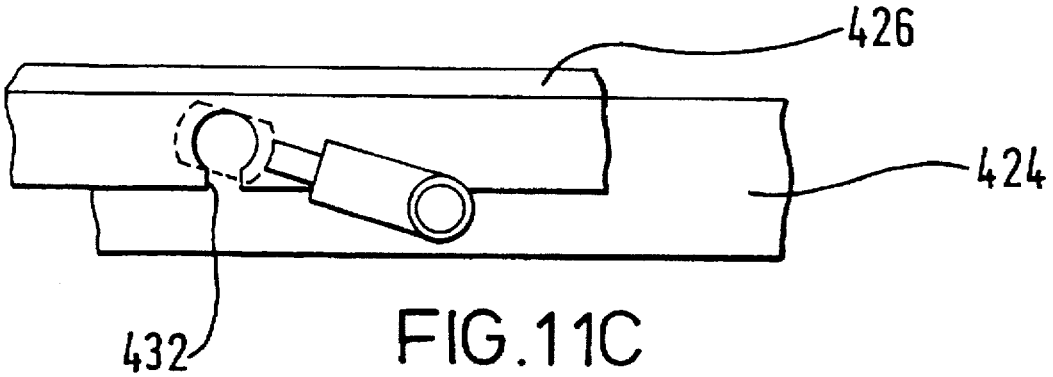
Figure 13A:
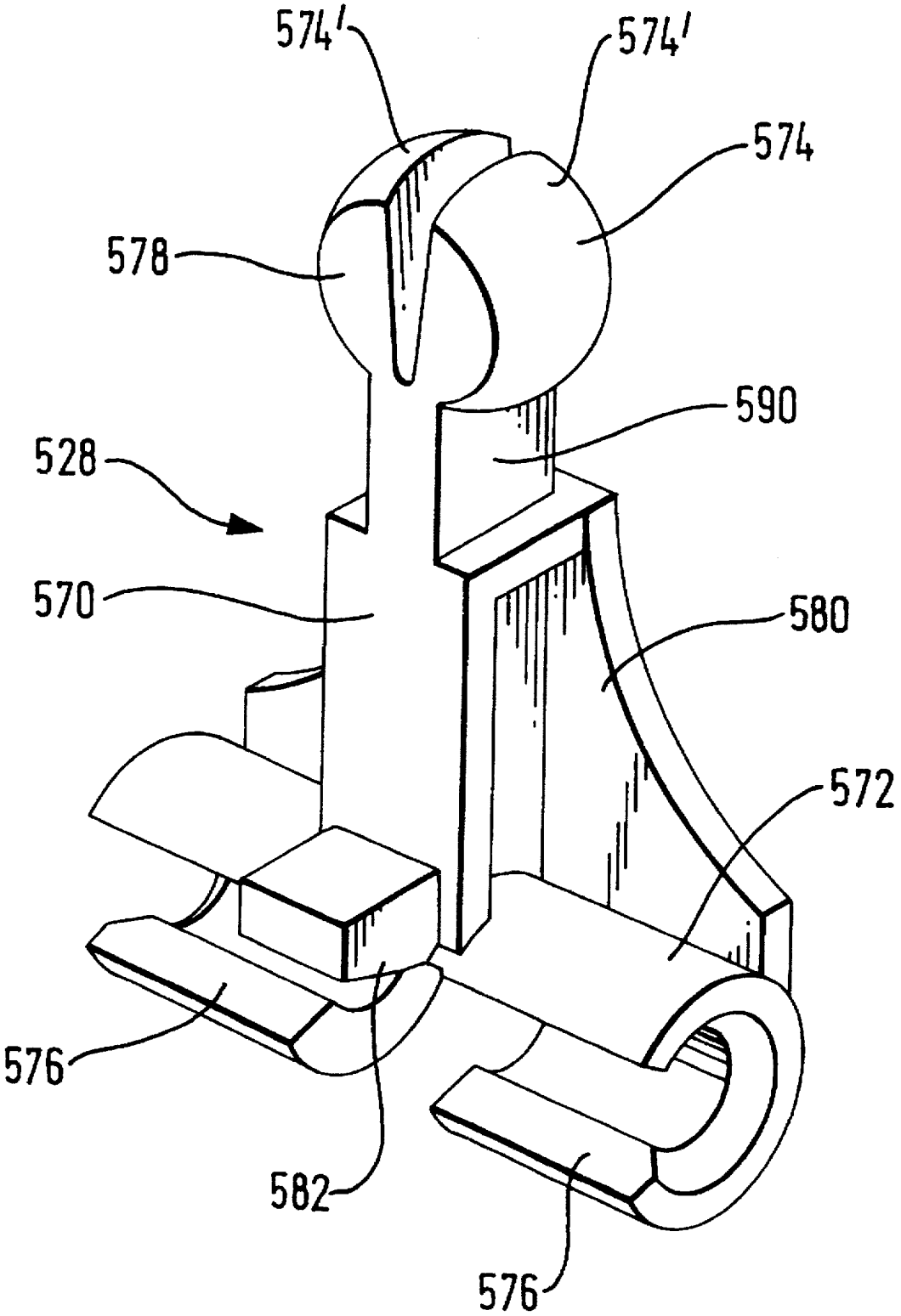
Figure 13B:
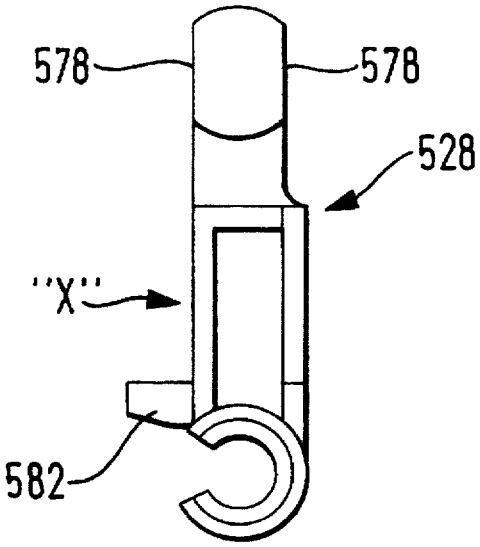
Figure 13C:
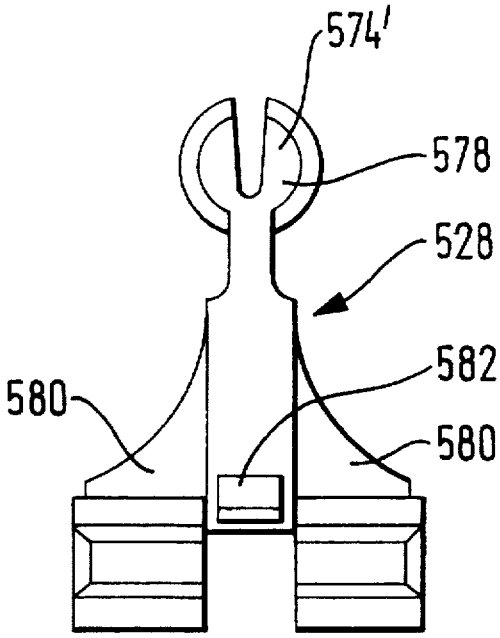
Figure 14:
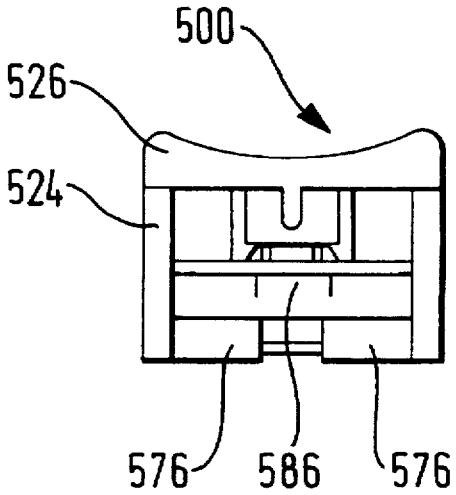
Figure 15:
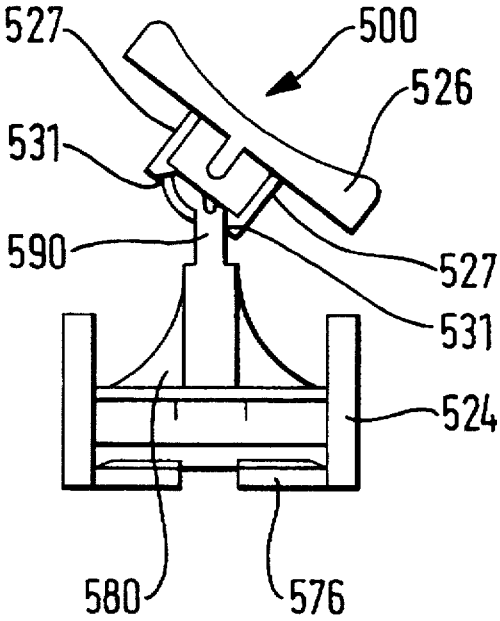
Figure 16:
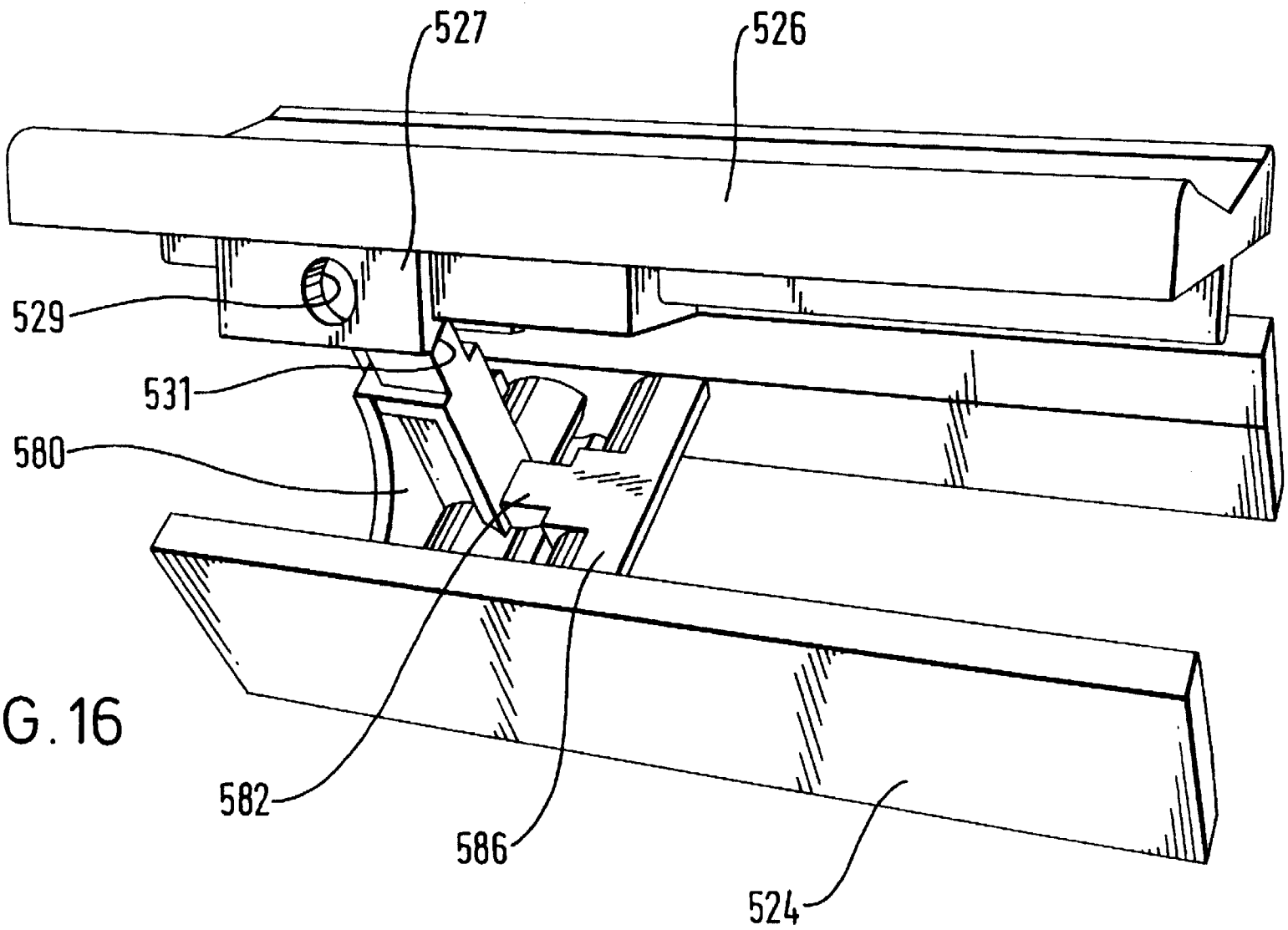
Figure 17:
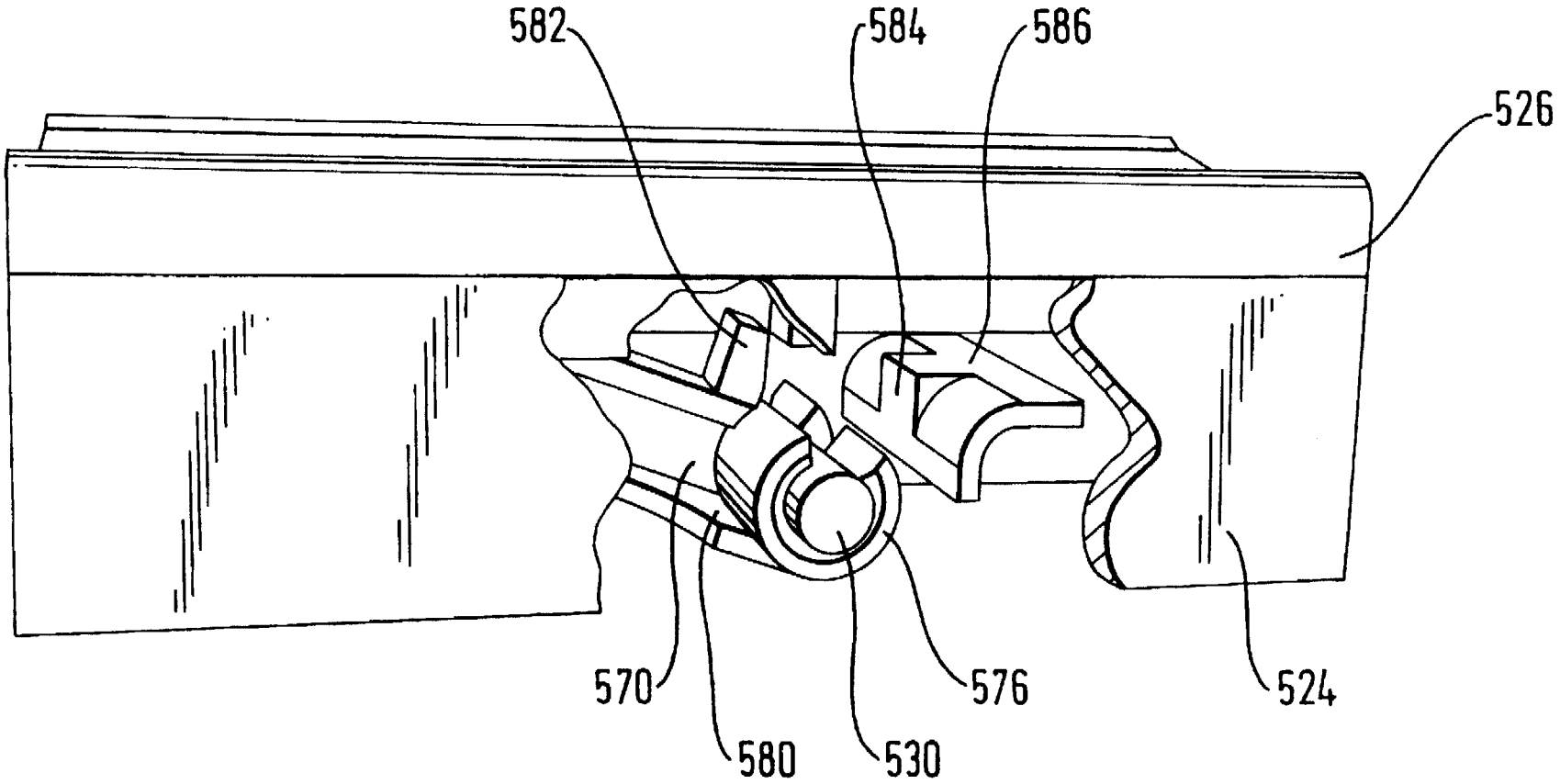
Figure 18:
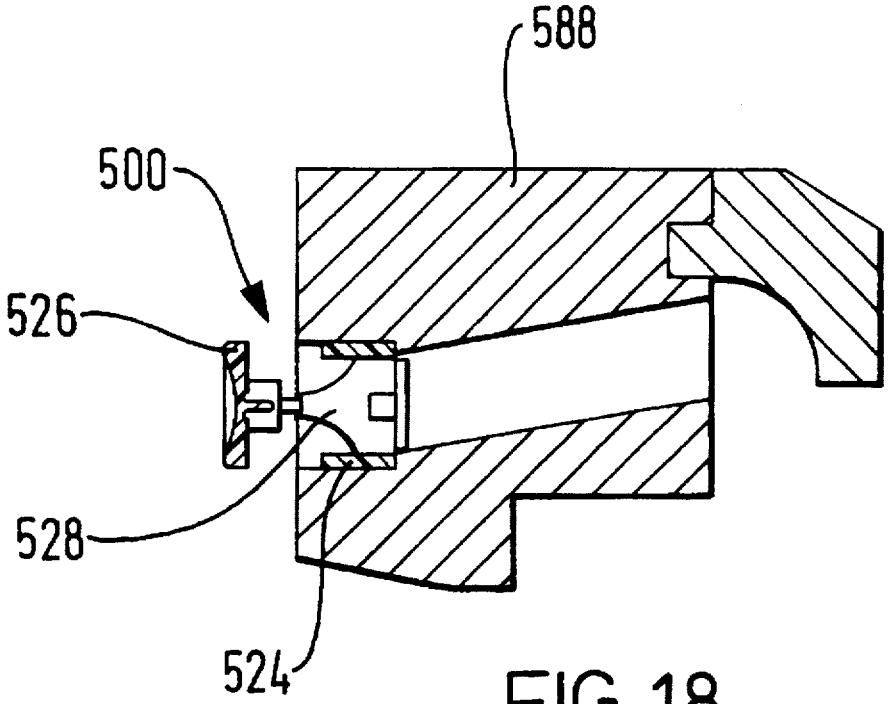
Figure 19:
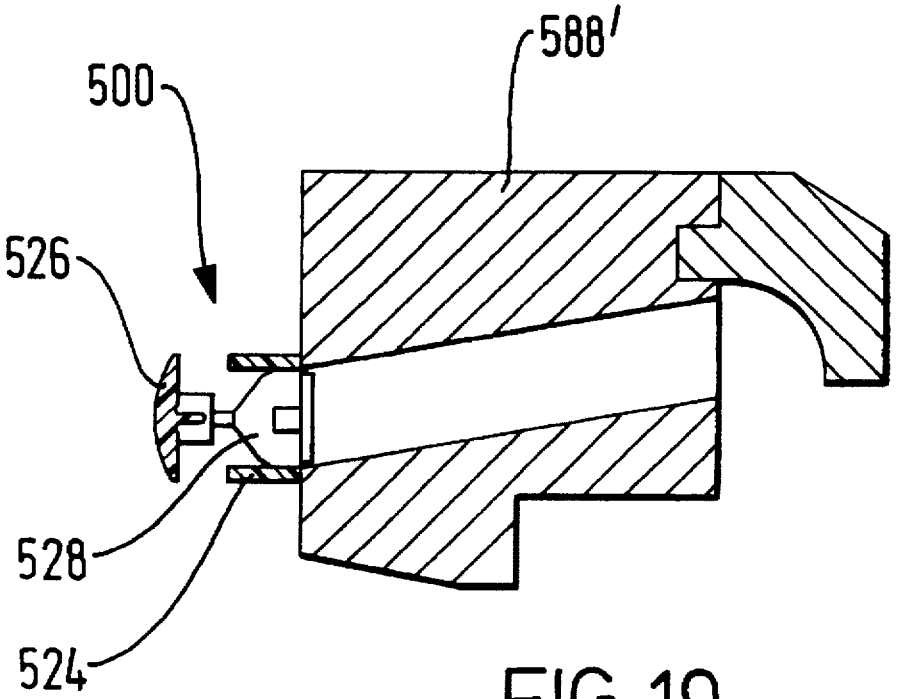
Figure 20A:
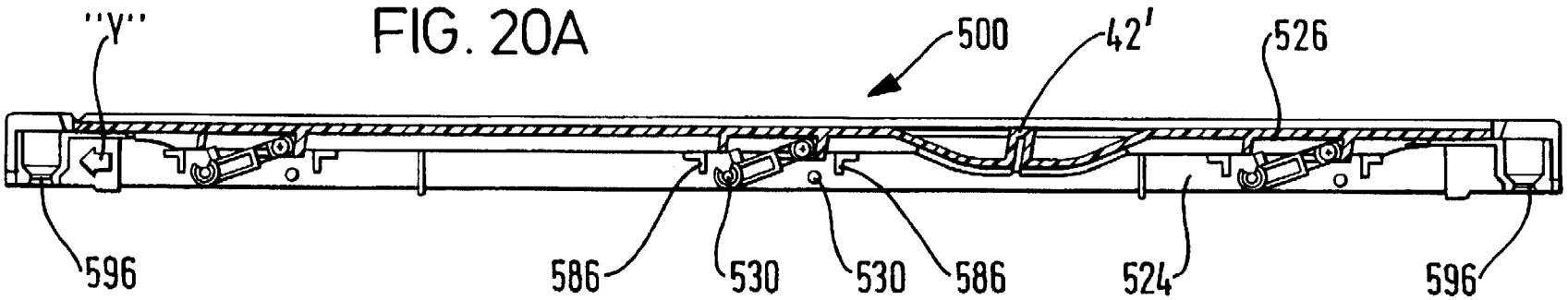
Figure 20B:
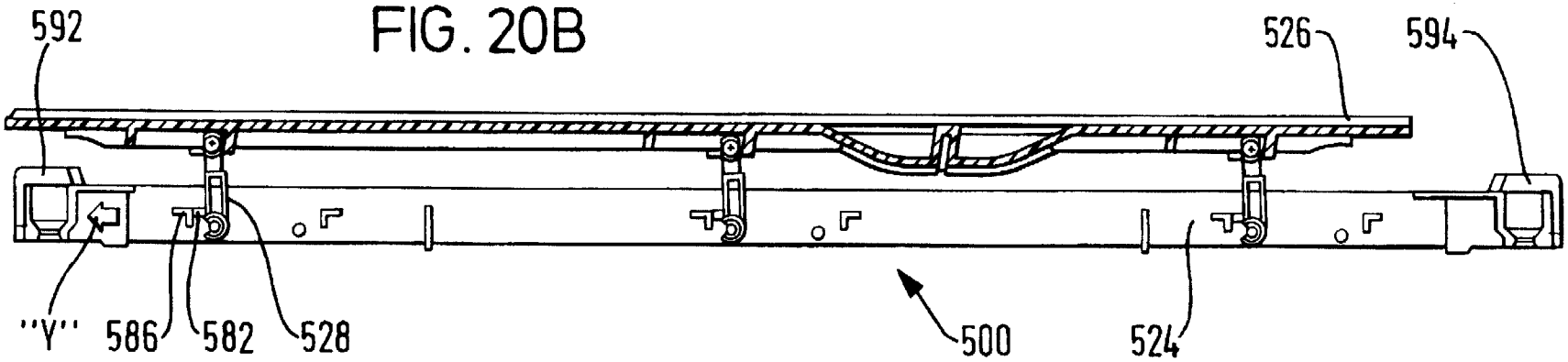
Figure 21A:
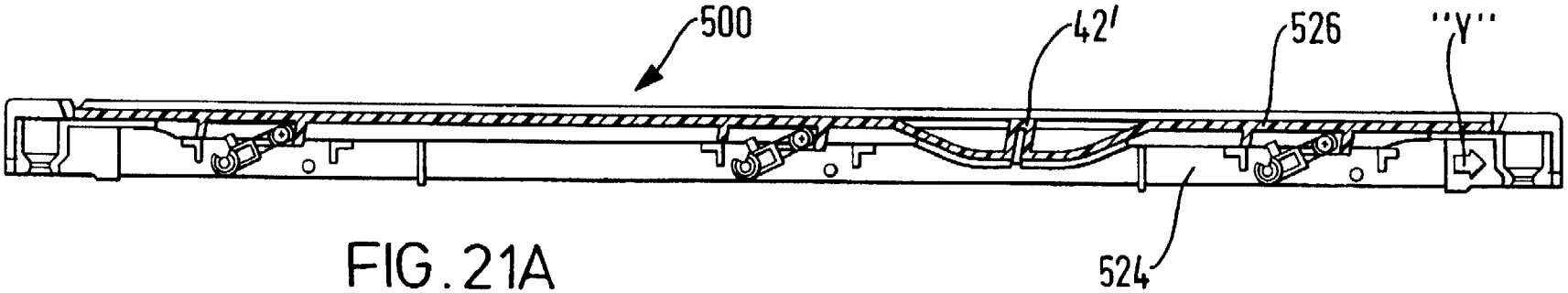
Figure 21B:
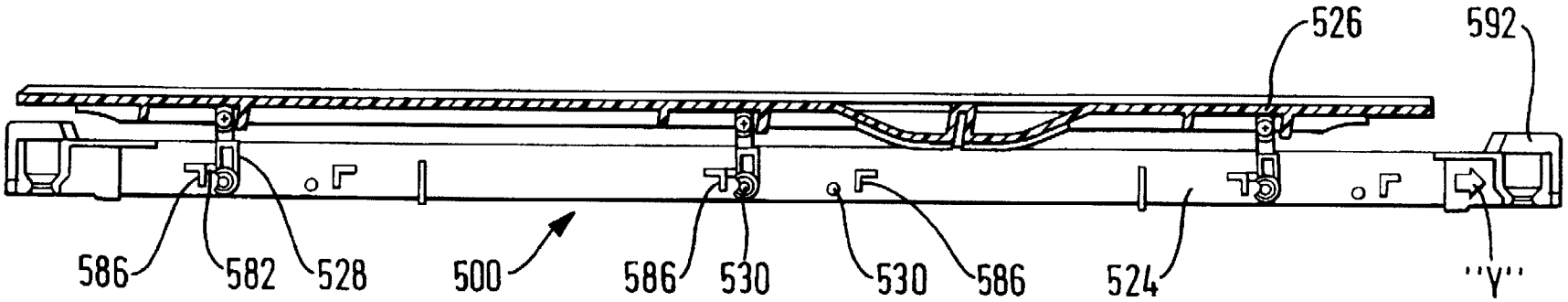
Figure 22:
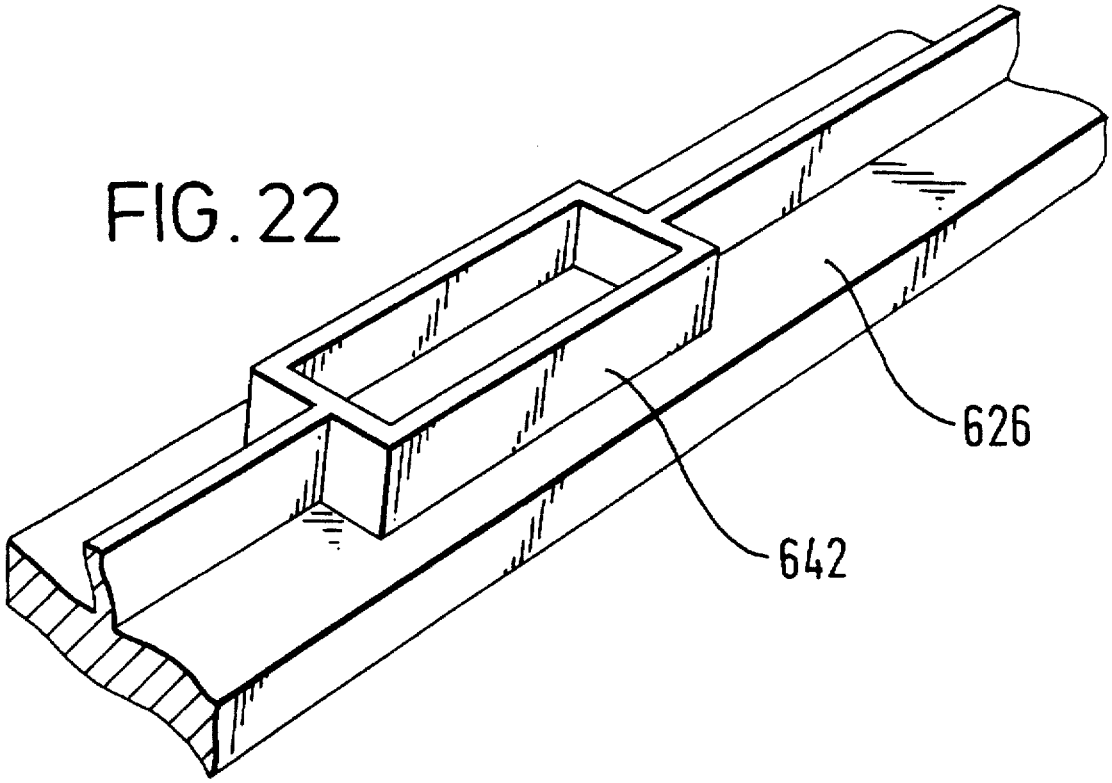
Figure 23:
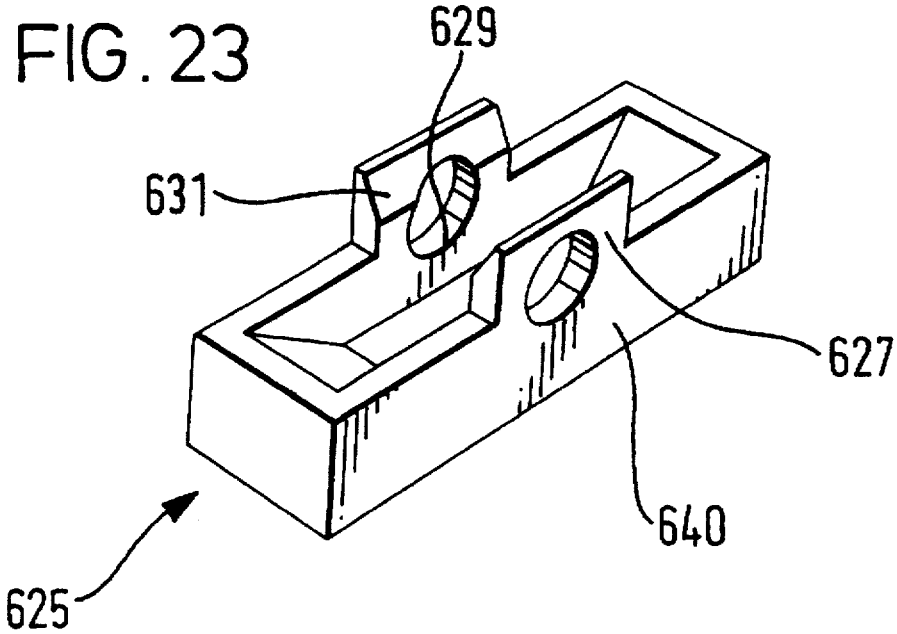

FIGS. 5A, 5B, and 5C are part-sectional side views of the embodiment of FIG. 4;

FIGS. 6A, 6B, and 6C are part-sectional end views of a slot ventilator in accordance with a third embodiment of the present invention;

FIGS. 7A, 7B, and 7C are part-sectional side views of the embodiment of FIG. 6;

FIGS. 8A, 8B, 8C and 8D are various part-sectional end views of a slot ventilator in accordance with a fourth embodiment of the present invention;

FIGS. 9A, 9B, and 9C are part-sectional side views of the embodiment of FIG. 8;

FIGS. 10A, 10B, and 10C are schematic end views of a slot ventilator in accordance with another embodiment of the present invention;

FIGS. 11A, 11B and 11C are schematic side views of the embodiment of FIG. 10;

FIGS. 12A, 12B, 12C, 12D, 12E and 12F show various stages in the assembly of the embodiment of FIGS. 10 and 11;

FIG. 13A shows a perspective view of a link for a slot ventilator in accordance with another embodiment of the present invention;

FIG. 13B is a side view of the link of FIG. 13A;

FIG. 13C is a side view of the link of FIGS. 13A and 13B in the direction X of FIG. 13B;

FIG. 14 is a view of the link of FIGS. 13A, 13B and 13C fitted in the ventilator, the ventilator being closed and viewed from the end;

FIG. 15 is a view corresponding to FIG. 14, but with the facing strip in an open angled position thereof;

FIG. 16 is a perspective view of part of the ventilator of FIGS. 14 and 15, the orientation of the facing strip corresponding to the orientation of FIG. 15;

FIG. 17 is a perspective partly cut away view of part of the ventilator of FIGS. 14, 15 and 16, with the facing strip shown in the closed position;

FIG. 18 is an end sectional view of the ventilator of FIGS. 14 to 17, installed in a recessed position in a window frame;

FIG. 19 is an end sectional view of the ventilator of FIGS. 14 to 17, mounted on the surface of a window frame;

FIGS. 20A and 20B are partly sectional side views of the ventilator of FIGS. 14 to 17, assembled for recessed installation as shown in FIG. 18, the facing strip being in closed and open positions respectively;

FIGS. 21A and 21B show partly sectional side views of the ventilator of FIGS. 14 to 17, assembled for surface mounting as shown in FIG. 19, the facing strip being in closed and open positions respectively;

FIG. 22 is a perspective view of part of the facing strip of a slot ventilator in accordance with a further embodiment of the present invention;

FIG. 23 is a perspective view of a socket for mounting to the facing strip of FIG. 22;

FIG. 24 is a perspective view of the socket of FIG. 23 mounted to the facing strip of FIG. 22; and FIG. 25 is an end sectional view of the socket of FIG. 23 mounted to the facing strip of FIG. 22.

Figure 2:
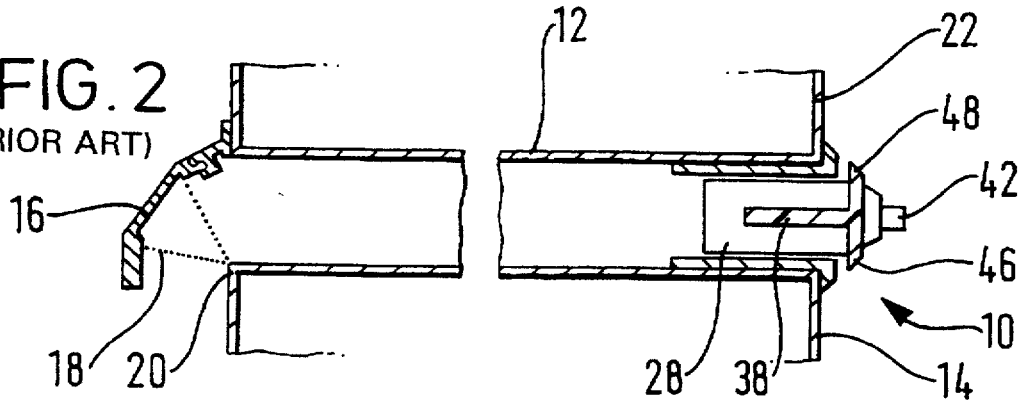
FIG. 2 (PRIOR ART)
FIG. 2 is a cross-sectional side view of the prior art slot ventilator of FIG. 1, when installed in a ventilation slot, in an open position thereof.

Referring to FIG. 2, a prior art slot ventilator 10 is shown installed in a ventilation slot 12 formed through a window or door frame 14.

A weather hood 16 is located at the exterior of the ventilation slot 12 for preventing rain from entering the slot. A fly screen mesh 18 is connected between the weather hood 16 and the lower side 20 of the ventilation slot for preventing insects from passing into the ventilation slot. The ventilator 10 is located on the interior side 22 of the window frame.

Figure 1:
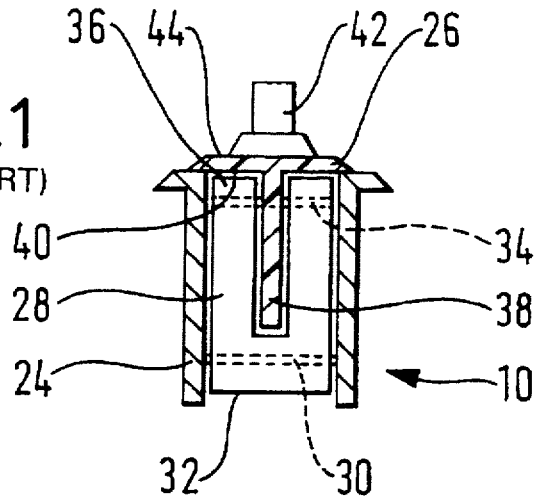
FIG. 1 (PRIOR ART)
FIG. 1 is a cross-sectional side view of a prior art slot ventilator in a closed position thereof.

Referring to FIG. 1, the prior art ventilator 10 includes a slotted backing member 24 and an elongate facing strip 26. The ventilator includes a pair of links 28, only one of which is shown in the drawings. The links 28 are spaced apart from one another along the length of the slot 24.

Each link is pivotally connected at one end 32 by a pivot pin 30 to the slotted backing member 24. Each link is also connected by a further pivot pin 34 at its other end 36 to a rib 38 which extends along the rear face 40 of the facing strip 26.

A snib 42 is located on the front face 44 of the facing strip 26 for controlling the ventilator.

In use, the snib 42 may be pulled forward to open the ventilator and pushed backwards to close the ventilator. The links 28 are substantially identical to one another and are arranged to remain parallel to one another as they rotate, therefore maintaining the facing strip 26 and backing member 24 parallel to one another. The arrangement of links 28 and pivot pins 30, 34 therefore provides a generally translational movement of the facing strip 26 relative to the backing member 24.

In the open position of the ventilator 10 shown in FIG. 2, incoming ventilation is directed downward by a lower part 46 of the facing strip, and upward by an upper part 48 of the facing strip 26 and, generally, the same amount of airflow is directed upward as downward.

Figure 3:
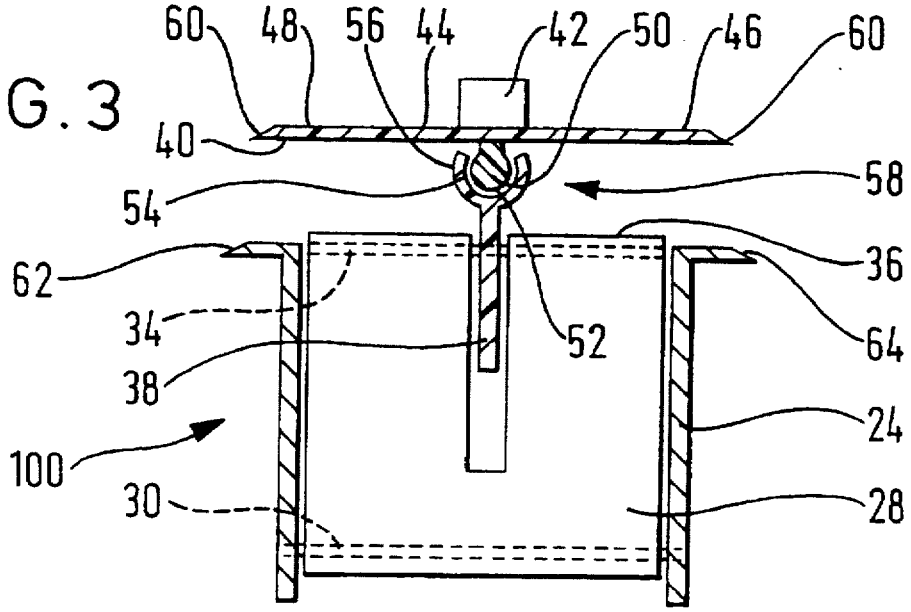
FIG. 3 is a part-side view of a slot ventilator in accordance with a first embodiment of the present invention.

In FIG. 3 which shows a slot ventilator in accordance with a preferred embodiment of the present invention, similar reference numerals have been used to denote parts of the ventilator similar to parts of the prior art ventilator of FIGS. 1 and 2.

The ventilator 100 includes an elongate rearwardly protruding element 50 located in the centre of the rear face 40 of the facing strip 26. The element 50 may be mounted on or formed integrally with the facing strip 26. When the facing strip 26 is formed by an extrusion process, it is convenient for the element 50 to be formed integrally therewith in the extrusion process. The protruding element 50 could if desired extend the length of, or at least a substantial part of the length of, the facing strip 26.

The element 50 has a rearwardly facing part-cylindrical surface 52 which engages with the cylindrical inner surface 54 of a part-cylindrical collar 56 mounted to or integral with the rib 38. In one embodiment, the rib 38 extends between and thus connects the forward ends 36 of the links 28. In this case, the rib is conveniently formed by an extrusion process. The collar 56 may be formed integrally therewith during the extrusion process.

During assembling of the ventilator 100, the element 50 and the collar 56 may be connected together simply by inserting the element 50 lengthwise into the collar 56. However, it is preferable that at least one of the element 50 and collar 56 should be of resilient material.

Assembly may be effected simply by snap-fitting the two parts together. A resilient material also has the advantage that it may provide for frictional holding of the angular orientation of the facing strip 46 relative to the rib 38.

It will be understood that the purpose of the rearwardly protruding element 50 and the collar 56 is to provide a hinge 58 for rotating the facings strip 26 relative to the backing member 24.

In use, the ventilator 100 may be opened from its closed position to the open position shown in FIG. 3 by a user pulling forward on the snib 42, rather like in the ventilator 10 of the prior art.

However, with the ventilator 100, the user can thereafter push the snib 42 up or down to rotate the facing strip 26 about a longitudinal axis (the axis passing through the hinge 58). For example, the facing strip 26 may be rotated clockwise from the position shown in FIG. 3. This would increase the incoming ventilation being directed up by the upper part 48 of the facing strip, whilst at the same time reducing the amount being directed down by the lower part 46 of the facing strip 26. The opposite effect is achieved by rotating the facing strip 26 in the anti-clockwise direction.

FIG. 3 shows the maximum open position of the ventilator 100 by which is meant that the axis of the pivot pins 30, 34 are aligned in the forward/backward direction, where it is no longer possible for the hinge 58 to move further forwards.

The dimensions of the links 28, backing member 24 and facing strip 26 are such that when the facing strip 26 is rotated clockwise or anticlockwise, one or other longitudinal peripheral edge 60 of the facing strip engages with one or other of upwardly 62 and downwardly 64 extending facing flanges of the backing member 24. From this fully deflected angular orientation, it is possible to close the ventilator 100 merely by pushing the snib backwards towards the closed position. During the closing movement, the peripheral edge 60 of the facing strip 26 slides across the facing flange 62 or 64 with which it is in contact. The closed position is reached once the other peripheral edge 60 and other facing flange 62, or 64 engage with one another.

When the element 50 is a friction fit inside the collar 56, the facing strip 26 is preferably adjustable to angular orientations intermediate that of the closed position and that of the fully deflected angular orientation. Indeed, in some embodiments there may be an infinite number of such intermediate orientations.

Thus, the ventilator 100 is highly adjustable and gives improved ventilation.

In the embodiment of FIG. 4, the slotted backing member 124 does not include, at its front side, upwardly 62 and downwardly 64 extending facing flanges as in FIG. 3. The embodiments of FIGS. 6 to 12 are similar to that of FIG. 4 in this respect.

The slotted backing member 124 of the FIG. 4 embodiment includes front surfaces 162, 164 with which the elongate facing strip 126 may engage in its closed position (see FIGS. 4C and 5C), or in its open fully-deflected angular orientations (see FIGS. 4A and 5A).

The embodiment of FIG. 4 includes two links 128. Each link 128 is pivotally connected to the backing member 124. The link comprises a pair of linkage arms 170, 172. Each linkage arm 170, 172 is pivotally connected at a first end thereof to a pivot pin 130 of the backing member 124. The link 128 includes, at the other ends of the linkage arms 170, 172 a first hinging component 174. The first hinging component 174 comprises a slotted collar portion 176 and pivot pegs 178 which extend from either side of the collar portion 176. The pivot pegs engage slotted jaws 180 on the ends of the linkage arms 170, 172. The purpose of the slotted jaws 180 is to allow for snap-fit assembly of the linkage arms 170, 172 to the hinging component 174. Although as will be seen from FIG. 5 the pivot pin 130, passes through bores 182 in the linkage arms 170, 172, the linkage arms 170, 172 could alternatively be provided with slotted jaw portions similar to those 180 connected to the hinging component 174. This would allow for simple assembly with the linkage arms 170, 172 being snap-fitted to both the slotted backing member 124 and the hinging component 174.

The facing strip 126 of the embodiment FIG. 4 includes a rearwardly facing rib 150 which extends along the longitudinal direction of the facing strip 126. The rib includes a cut-out 183 adjacent to each link 128. Each cut-out is bridged by a cylindrical element 184 which constitutes a second hinging component of the hinge 158 of the ventilator. The slotted collar portion 176 of the hinging component 174 has a cylindrical inner surface 152 which is arranged resiliently to engage the cylindrical element 184, so that the facing strip 126 may be resiliently held in the open position (see FIG. 4B and 5B), or any selected angular orientation thereof, such as shown in FIG. 4A and 5A.

The slotted collar portion 176 (or the element 184) is resilient to the extent that, during assembly, the cylindrical element 184 bridging the cut-out 183 in the rib 150 may snap-fit into the collar.

The embodiment FIG. 4 is therefore particularly simple and quick to assemble. Preferably, any or all of the parts of the ventilator of FIG. 4 may be of moulded plastics material. However, parts of the ventilator could be made of any other suitable material such as aluminium, and made by extrusion or casting, rather than moulding.

The ventilator of FIG. 4 may include a snib (not shown) mounted to the facing strip, rather like the snib 42 of FIG. 3. Alternatively, the facing strip 126 may be provided with a recess (not shown) in which an operation surface or element is mounted or formed.

The ventilator of FIG. 4 may be mounted to a window or door structure (or any other suitable structure) in a recessed position, whereby, in the closed position (see FIG. 4C and 5C) the facing strip 126 is flush with the front surface of the structure (not shown).

The embodiment of FIGS. 6 and 7 is very similar to that of FIGS. 4 and 5. Like reference numerals denote similar parts. However, in FIGS. 6 and 7, the slotted collar portion 176 of FIGS. 4 and 5 is substituted by a saddle element 276. The seat 278 of the saddle 276 includes a cylindrical inner surface 280 which is arranged to engage the cylindrical element 184 which bridges the cut-out 182 in the rib 150.

In the FIG. 6 and 7 embodiment, the linkage arms 270, 272 include pegs 284 which engage bores (not shown) in the legs 282 of the saddle 276. During assembly, one leg 282 of the saddle 276 may be inserted through the gap formed by the cut-out 182 and cylindrical element 184. The cylindrical inner surface 280 of the saddle 276 subtends to an angle somewhat greater than 180 degrees, as shown in FIG. 6. Thus, the saddle may snap-fit into engagement with the cylindrical element 184, during assembly and, thereafter, the pegs 282 of the linkage arms 270, 272 maybe inserted into the bores (not shown) of the saddle 276. Once assembled, the saddle 276 resiliently grips the cylindrical element 284 so that the facing strip 126 may be resiliently held in any selected angular configuration, such as one of the various configurations shown in FIG. 6A.

The pivot pin 230 of the FIG. 6 and 7 embodiment includes bosses 232 for holding the linkage arms 270, 272 in proper lateral relationship to the backing member 124. Similar bosses could be employed in other embodiments, such as the FIG. 4 and 5 embodiment.

FIGS. 8 and 9 show a further embodiment similar to that of FIGS. 4 and 5. Again, like reference numerals are used to denote similar parts. In the FIG. 8 and 9 embodiment, the links 128 include ball and socket joints 300 to provide the hinge of the ventilator. In this embodiment, rather than employing the rib 150 of FIGS. 4 and 5, ball elements 302 are mounted to or formed with the rear of the facing strip 126, and the links 128 include cup sockets 304. The ball elements 302 are arranged to snap-fit into the cup sockets 304 during assembly. The engagement of the ball elements 302 and sockets 304 is shown in section in detail in FIG. 8D. Preferably, the cup sockets 304 resiliently grip the ball elements 302 so that the facing strip 126 may be resiliently held in any selected angular configuration thereof. FIG. 8A shows various angular configurations of the facing strip 126. It will be realised that in another embodiment, sockets similar to the cup sockets 304 could be mounted on the facing strip 126, and ball elements similar to the ball elements 302 could be mounted on the links 128.

FIGS. 10 to 12 show another ball and socket type of embodiment. FIGS. 12A, 12B and 12C show a link 428 prior to connection with the facing strip 426 of the ventilator. As the side view of FIG. 12A shows, the link 428 includes only one linkage arm 470 which terminates at one end in a T-piece 472, and at the other end in a ball element 474. The T-piece includes pegs 476 at either end of the "T". The link 478 is of a relatively resilient material so that, during assembly to the backing member 424, the pegs 476 resiliently snap-fit into bores (not shown) in either side of the backing member 424.

The ball element includes two flatted opposing surfaces 478.

Figure 12A:
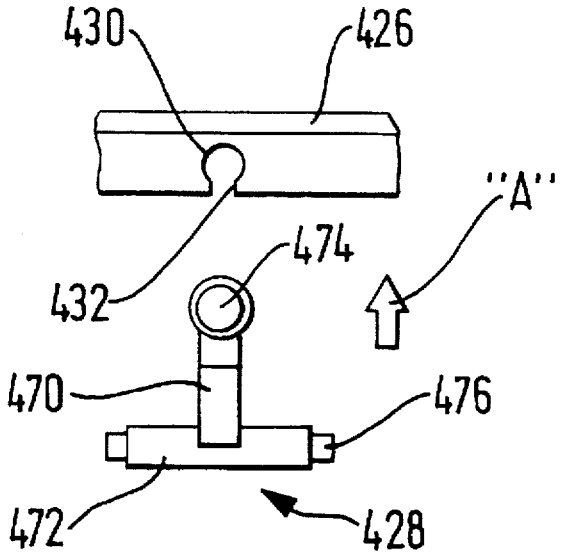
Figure 12B:
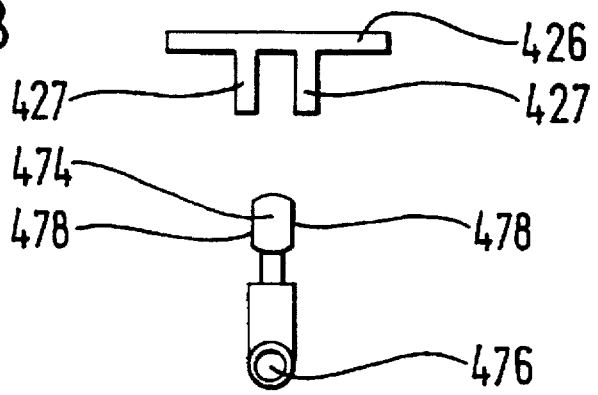

As the end view of FIG. 12B shows, the facing strip 426 includes two longitudinally extending ribs 427 which are spaced apart by a distance approximately equal to the distance between the flatted surfaces 478 of the ball element 474. During assembly, the link 427 is moved from the position shown in FIGS. 12A, 12B (and the bottom view 12C), in the direction of the arrow "A" in FIG. 12A, until the ball element 474 is located between generally circular cut-outs 430 in each of the ribs 428. Subsequent to this movement, the link 428 may be rotated 90 degrees as shown by the arrow "B" in the bottom elevational view of FIG. 12F, causing the spherical surface of the ball element 474 to engage each of the circular cut-outs 430 of the ribs 428, this locking the link 428 to the facing strip 426, as shown in the side view of FIG. 12D, and end view of FIG. 12E.

Figure 12C:
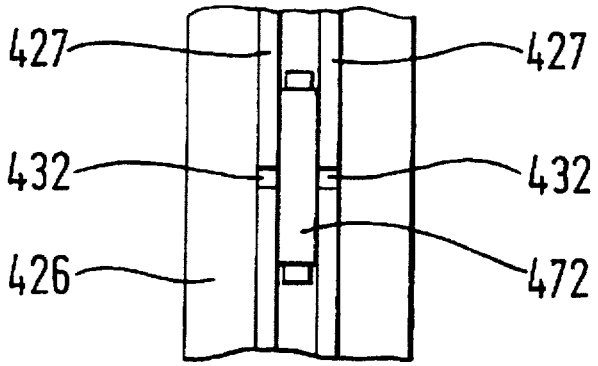
Figure 12D:
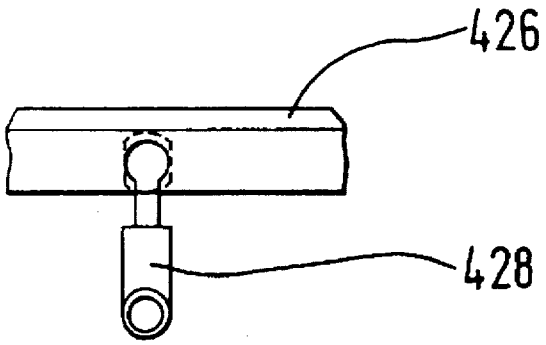
Figure 12E:
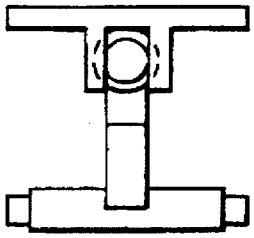
Figure 12F:
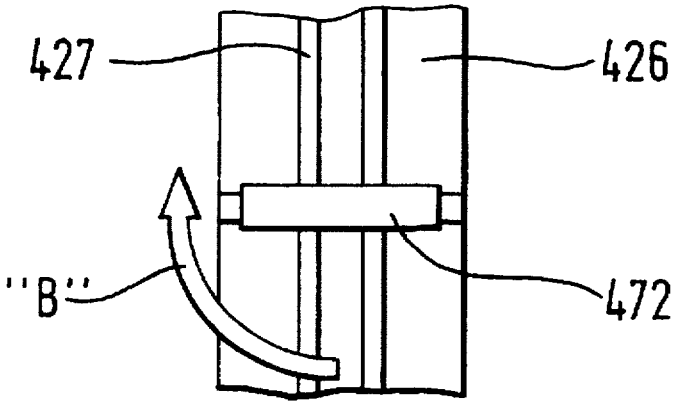

Adjacent to the circular cut-outs 430, the ribs 427 include slotted cut-outs 432, as shown in FIGS. 12A, 12C and 11C. The purpose of the slotted cut-outs 432 is to permit the facing strip 462 to rotate from the open position of FIGS. 10B and 11B to an angular configuration, such as that shown in FIG. 10A and 11A. The slotted cut-outs 432 accommodate the linkage arm 470 during rotation to angular orientations of the facing strip 426. Although only one link 428 is shown in FIGS. 10 to 12, preferably two similar links are employed spaced longitudinally from one another along the length of the ventilator, as in the embodiments of FIGS. 4 to 9.

FIGS. 13A, 13B and 13C show a link for use in the ventilator 500 of FIGS. 14 to 21. The link 528 is similar to the link 428 shown in FIGS. 10 to 12 in that it includes a ball element 574 with opposing flatted surfaces 578 and a linkage arm 570. However, the linkage arm 570 terminates at its end opposite the ball element 574 in a T-piece 572 including a pair of resilient jaws 576 which are arranged for snap-fit connection to a pivot bar 530 (see FIG. 17) of the backing member 524 of the ventilator 500. The link 528 includes webs 580 which extend between the linkage arm 570 and jaws 576 and which strengthen the link 528. In the region where the linkage arm 570 meets the jaws 576, the link 528 includes an abutment portion 582.

The abutment portion 582 is adapted, on rotation of the link 528 around the pivot bar 530, to engage an abutment surface 584 of a bridge element 586 which extends between the two internal side faces of the backing element 524. The engagement between the abutment portion 582 and abutment surface 584 prevents further rotation of the link 528 about the pivot bar 530 and therefore defines the fully open position of the facing strip 526 of the ventilator 500 (see FIGS. 16, 20B and 21B). This arrangement has a significant advantage over the prior art ventilator shown in FIGS. 1 and 2. In the prior art ventilator, the open position is defined by engagement between the longitudinal rib 38 and a portion of the backing member 24. The engagement between the abutment portion 582 of the link 528 has the advantage that, for different applications, links with linkage arms 570 of different lengths may be employed and one can always be sure that an appropriate fully open position of the facing strip 526 will be obtained.

In FIGS. 20A and 20B, the ventilator 500 is fitted with a slightly longer link 528 than in FIGS. 21A and 21B. A longer link 528 gives the ventilator further forward movement of the facing strip 526 so that the ventilator, when installed in a recessed manner as shown in FIG. 18 into a structural element such as a window frame 588 will be capable of providing the same amount of ventilation as the ventilator 500 with a shorter link when mounted on the surface of a window frame 588' as shown in FIG. 19.

It will be seen from FIGS. 20B and 21B that, in the fully open position of the facing strip 526, with both lengths of link 528, the link takes up the same slightly over-centre position with respect to the forward/rearward direction of the ventilator. This over-centring of the link 528 has the advantage that the facing strip 526 is not liable to slamming closed when subjected to sudden gusts of wind.

As will be most clearly seen from FIGS. 13A and 13C, the ball element 574 of the link 528 is split into two sphere portions 574'. The facing strip 526 includes two ribs 527 (see FIGS. 15 and 16) which include circular bearing surfaces 529 (see FIG. 16) which engage the sphere portions 574' of the ball element 574 of the link 528. The ball element 574 is of resilient material and the natural spacing between the sphere portions 574' shown in FIG. 11 is slightly further apart than the position taken up when the ball element 574 is held captive between the bearing surfaces 529. The resilience of the ball element 574 thus ensures that there is a certain amount of friction in the engagement between the ball element 574 and bearing surfaces 529 which advantageously results in the facing strip 526, once moved to a particular angular orientation, being held in that orientation until a further manual input is applied.

Instead of employing slotted cutouts like those 432 shown in FIG. 12, the ribs 527 are provided with ramp surfaces 531 (See FIGS. 15 and 16) which enable rotation of the facing strip 526. It will be seen that maximum rotation of the facing strip 526 about the longitudinal axis thereof is reached when one of the ramp surfaces 531 engages against a neck portion 590 of the linkage arm 570 which is adjacent the ball element 574.

Assembly of the link 528 to the facing strip 526 is similar to the assembly procedure shown in FIG. 12. However, the use of the ramp surfaces 531 means that the flatted surfaces 578 of the ball element 574 do not need to be exactly aligned with the length of the facing strip 526 before insertion between the ribs 527; instead, so long as the flatted surfaces 578 are aligned to within about 45 to 60 degrees from the longitudinal direction of the facing strip 526, the ball element 574 may be inserted between the ribs 527 and then rotated to engage the bearing surfaces 529.

The jaws 526 of the link 528 are subsequently snap-fitted onto an appropriate one of the pivot bars 530.

It will be evident from FIGS. 20 and 21 that the ventilator 500 includes three links 528. These may be identical to one another but it is also envisaged that only one or two of their ball elements 572 could be of the split type shown in FIG. 11, the other ball elements being solid like that 474 shown in FIG. 12.

It will also be seen from FIGS. 20 and 21 (meaning respectively FIGS. 20A and 20B, and FIGS. 21A and 21B collectively) that the backing member 524 includes two series of three pivot bars 520 and bridging elements 586.

In FIG. 20, the jaws 576 of the links 528 are attached to one of the series of pivot bars 530 and the abutment portions of the links 528 are adapted to engage one of the series of bridging elements 586 in the open position of FIG. 20B.

In FIG. 21, as mentioned above, the links 528 are shorter than the links used in FIG. 20. The orientation of the backing member 524 relative to the facing strip 526 is reversed between FIGS. 20 and 21—note that a marker arrow "Y" points to the left in FIG. 20 and to the right in FIG. 21. Thus it will be realised that the series of three pivot bars 530 and bridging elements 586 which were redundant in FIG. 20 are now used in FIG. 21, and those which were used in FIG. 20 are now redundant.

Thus, the two series of pivot bars 530 and bridging elements 586 permit the same facing strip 526 and backing member 524 to be used with links 528 of different lengths. It will be realised that if the long links 528 of FIG. 20 were replaced with the short links of FIG. 21 without reversing the orientation of the backing member 524 relative to the facing strip 526, the facing strip would foul against a left end cap 592 of the backing member 524 when approaching the closed position. Likewise, if the short links of FIG. 21 were replaced with the long links of FIG. 20 without reversing the orientation of the backing member 524 relative to the facing strip 526, the facing strip 526 would foul against the (now right) end cap 592 of the backing member 524.

The end cap 592 and an end cap 594 at the other end of the ventilator 500 are removable from the backing member 524 to permit access to screw holes 596 for mounting the ventilator 500 to a structure such as the window frames 588, 588' shown in FIGS. 18 and 19.

With the particular ventilator 500 shown in FIGS. 20 and 21, the long link 528 shown in FIG. 20 is about 4 mm longer than the short link 528 shown in FIG. 21. The distance between the centre of the ball element 574 and the centre of the jaws 576 is about 18 mm for the long link and 14 mm for the short link. In other ventilators, different lengths could be used. In other ventilators, there need not be one bridging element 586 for every link 528, as shown in FIGS. 20 and 21.

It is preferred that both the links 528 and the bearing surfaces 529 which they engage are of plastics material. The ventilator shown in FIGS. 14 to 21 has a moulded plastics facing strip 526 with which the ribs 527 and bearing surfaces 529 are integrally moulded. In some applications, it may be desirable for the facing strip to be of metal. FIGS. 22 to 24 show how a metal facing strip 626 may be connected to a plastics element 625 which includes ribs 627 including circular bearing surfaces 629 for engagement with the ball element of a link (not shown) like the link 528 shown in FIG. 11 for use with a backing member (not shown) like the backing member 524. The plastics element 625 includes ramped surfaces 631 on the ribs 627 which have the same purpose as that described above with reference to FIGS. 15 and 16.

The plastics element 625 includes a base portion 640 which is adapted for insertion between walls on the rear of the facing strip. Subsequently, the walls 642 may be deformed by a suitable tool (not shown) to form projections 644 over the base 640 of the plastics element 625 to hold the plastics element 625 captive between the walls 642.

It would of course also be possible to incorporate two, three or more links in any of the embodiments of ventilator described above.

The lateral dimension of the embodiments discussed above, and indeed in other embodiments in accordance with the invention, may be of a size such that the ventilator is suitable for installation to a 12, 13, 16, or 18 millimetre slot aperture in a structure to be ventilated, or to fit any other desired size of aperture.

Preferably, slot ventilators in accordance with the present invention, when fully open, provide a minimum airflow path area of at least 4,000 square millimetres and more preferably at least 6,000 or at least 8,000 square millimetres.

Ventilators in accordance with the invention may include a protruding snib for operation thereof like the snib 42 shown in the prior art ventilator of FIG. 1 or they may include a recessed snib such as the snib 42' shown in FIGS. 20 and 21.

At least some embodiments of slot ventilators in accordance with the present invention may be installed in the sash or outer frame of a window. The window frame may include a ventilation slot which emerges from an inner face of a spar of the frame, the inner face facing an opposite spar of the frame, and the ventilator may be installed in the ventilation slot.

Conventionally, ventilators have been installed on generally vertical faces of window frames. When the ventilator is installed on the inner face facing an opposite spar, the ventilator does not spoil the sight line of an observer so much and is therefore more attractive. Also, when installed in a top spar of a window adjacent to the ceiling of a room, incoming ventilation does not tend to be restricted by the closeness of the ceiling. Furthermore, in this case, the ventilator may be physically lower in the room than when installed conventionally on a vertical face, and may therefore be easier to reach for operation thereof.

We claim:

1. A slot ventilator (100, 500) comprising a slotted backing member (24, 124, 424, 524), an elongate facing strip (46, 126, 426, 526, 626) and a linking mechanism connecting the backing member and facing strip with one another, the linkage mechanism being arranged to permit generally translational forward and backward movement of the facing strip, in which the linkage mechanism restrains motion of each end of the facing strip during forward motion of the facing strip to motion along a predetermined course with the position of each end during such motion being dependent upon the position of the other end, between a closed position in which the slot is closed and an open position in which the facing strip is spaced in front of the backing member, the linkage mechanism including a hinge allowing the facing strip to rotate about a longitudinal axis to vary the angular orientation thereof.

2. A slot ventilator as claimed in claim 1 in which the facing strip, in an angled configuration thereof, engages the front of a wall defining the slot.

3. A slot ventilator as claimed in claim 1 in which the facing strip is selectable to an intermediate angular orientation intermediate that of the closed position and that of a fully deflected angular orientation.

4. A slot ventilator as claimed in claim 3 in which the facing strip is rotationally selectable between an infinite number of said intermediate orientations.

5. A slot ventilator as claimed in claim 3 in which the linkage mechanism includes friction means (50, 56; 176, 184; 276, 184; 302, 304; 574', 529; 629) for holding the facing strip by friction in a said intermediate orientation.

6. A slot ventilator as claimed in claim 1 in which the linkage mechanism includes a series of at least two links (28, 128, 428, 528), the links being spaced from one another along the length of the slot.

7. A slot ventilator as claimed in claim 6 in which the backing member includes a selection of two or more series linkage mechanism mounting formations (530) spaced from one another along the slot, the spacing between mounting formations in each series corresponding to the spacing between the links in the series of links.

8. A slot ventilator as claimed in claim 6 in which a said link includes a linkage arm (170, 172, 270, 272, 470, 570), the linkage arm being pivotally connected at a first end thereof to the backing member, the link including, at a second end of the linkage arm, a first hinging component (54, 176, 276, 302, 474, 574), the first hinging component being hingedly coupled to a second hinging component (50, 184, 184, 304, 427, 527, 625) which is mounted to the facing strip.

9. A slot ventilator as claimed in claim 8 in which the first hinging component is pivotally coupled to the linkage arm.

10. A slot ventilator as claimed in claim 8 in which the first hinging component is a snap-fit, during assembly, to the second hinging component.

11. A slot ventilator as claimed in claim 6 in which one of said links includes a stop portion which is adapted, on movement of the facing strip to the open position, to engage a stop portion of the facing strip, engagement of the respective stop portions preventing movement of the facing strip past the open position.

12. A slot ventilator as claimed in claim 6 in which one of the link and backing member is of resilient material such that the link is a snap-fit, during assembly, to the backing member.

13. A slot ventilator as claimed in claim 1 in which the hinge comprises an element (50, 184, 184) with a part-cylindrical exterior surface which is arranged to rotate inside a cylindrical collar (56, 176, 276), one of the collar and element being mounted to or integrally formed with the facing strip.

14. A slot ventilator as claimed in claim 13 in which the collar includes a longitudinal slot (183) through which the element is insertable with a snap-fit to engage the collar.

15. A slot ventilator as claimed in claim 1 in which the hinge incorporates a ball and socket joint, the ball (474, 574) including a pair of opposed flatted surfaces (478, 578), the socket comprising a pair of spaced circular bearing surfaces (430, 529).

16. A slot ventilator as claimed in claim 1 in which the hinge incorporates a ball and socket joint, the ball (474, 574) including a pair of opposed flatted surfaces (478, 578), the socket comprising a pair of spaced circular bearing surfaces (430, 529), and in which the ball comprises a split ball, the split ball comprising a plurality of sphere portions (574) which are resiliently coupled together so as to engage the socket resiliently with spherical outwardly facing surfaces of the sphere portions being resiliently biassed towards the socket.

17. A slot ventilator as claimed in claim 1 in which the backing member includes upwardly and downwardly extending facing flanges, the facing strip includes a peripheral edge which engages one of the facing flanges when the facing strip is rotated about the longitudinal axis of the hinge to a fully deflected angular orientation, whereby during closing movement of the facing strip, the peripheral edge of the facing strip slides across the facing flange with which it is engaged, and the facing strip is movable from an angled open position to the closed position merely by applying force in a direction parallel to the depth of the slot in the backing member.

18. A slot ventilator as claimed in claim 1 in combination with a window frame, the window frame including a ventilation slot, the ventilator being installed in the ventilation slot.

19. A slot ventilator as claimed in claim 1 in which the linkage mechanism restrains the two ends of the facing strip during the generally translational movement to maintain the facing strip parallel to the backing member.

20. A slot ventilator as claimed in claim 6 in which one of said links includes a stop portion which is adapted, on movement of the facing strip to the open position, to engage a stop portion of the backing member, engagement of the respective stop portions preventing movement of the facing strip past the open position.

* * * * *